US006637635B2

(12) United States Patent
Borjesson et al.

(10) Patent No.: US 6,637,635 B2
(45) Date of Patent: Oct. 28, 2003

(54) CLINCHING MECHANISM FOR STAPLERS

(75) Inventors: Marcus Borjesson, Hestra (SE); Frank Ambjornsson, Hestra (SE); Trygrve Gustafsson, Asenhoga (SE); Mats Andersson, Mullo (SE)

(73) Assignee: Isaberg Rapid AS (SE)

( * ) Notice: Subject to any disclaimer, the term of this patent is extended or adjusted under 35 U.S.C. 154(b) by 0 days.

(21) Appl. No.: 10/179,976

(22) Filed: Jun. 26, 2002

(65) Prior Publication Data

US 2003/0000992 A1 Jan. 2, 2003

(30) Foreign Application Priority Data

Jun. 27, 2001 (GB) ..... 0115712

(51) Int. Cl.[7] ..... B25C 7/00
(52) U.S. Cl. ..... 227/155; 227/154
(58) Field of Search ..... 227/85, 154, 155, 227/156

(56) References Cited

U.S. PATENT DOCUMENTS

| | | | | |
|---|---|---|---|---|
| 2,267,185 A | * | 12/1941 | Bauwens | 227/77 |
| 2,987,725 A | * | 6/1961 | Heilman | 227/85 |
| 3,986,533 A | * | 10/1976 | Woodman, Jr. | 140/105 |
| 4,546,910 A | * | 10/1985 | Logtens | 227/155 |
| 4,593,847 A | | 6/1986 | Hagemann | |
| 5,004,142 A | * | 4/1991 | Olesen | 227/155 |
| 5,385,287 A | * | 1/1995 | Scheuten | 227/155 |
| 5,516,025 A | * | 5/1996 | Eriksson | 227/155 |
| 5,586,710 A | * | 12/1996 | Golicz | 227/155 |
| 6,036,074 A | * | 3/2000 | Manabe | 227/155 |

FOREIGN PATENT DOCUMENTS

| | | |
|---|---|---|
| EP | 0 838 310 | 4/1998 |
| GB | 2 325 878 | 12/1998 |
| WO | WO 90/08015 | 7/1990 |

* cited by examiner

*Primary Examiner*—Scott A. Smith
*Assistant Examiner*—Chukwurah Nathaniel
(74) *Attorney, Agent, or Firm*—Nixon & Vanderhye PC

(57) ABSTRACT

A clinching mechanism has an anvil composed of first (1), second (2) and third (3) plates arranged in a spaced apart stack with the second plate (2) positioned between the other two. The plates (1, 2, 3) are mounted on a housing (43) so as to be slidable relative thereto and the second plate is also connected to the first and third plates (1, 3) so as to be slidably movable relative to said first and third plates between a first aligned position in which at least one edge of the first, second and third plates (1, 2, 3) are aligned to form and anvil face and a second retracted position in which the second plate (2) is retracted from the anvil face. With the second plate in its aligned position, a staple to be clinched in received with its two legs (72) on either side of the second plate (2), the second plate operating to guide the legs (72) into engagement with associated clinching device (7, 8, 17, 18) positioned between the first and second, and the second and third plates. Once the staple is located, the second plate (2) is moved to its retracted position in which it is partially retracted from between the legs. The clinching device are then operated to fold the legs (72) towards the staple crown and also urge the legs (72) laterally towards each other, the retraction of the second plate (2) permitting the legs (72) to be clinched into close alignment with each other.

19 Claims, 26 Drawing Sheets

CLINCHING MECHANISM FOR STAPLERS

The present invention relates to clinching mechanisms for stapler devices which include movable clinching wings that operate to fold the legs of a staple against a work piece.

BACKGROUND OF THE INVENTION

Automatic stapler devices are commonly used in modern photocopiers and the like, and it is an important feature of the design of such automatic stapler devices that, after clinching of the legs of a staple, the staple project a minimum distance above and below the upper and lower surfaces respectively of a work piece so as to minimise the impact which the presence of the staple has on the overall thickness of the work piece. This has been achieved by the use of clinching wings which are actuated once a staple has been driven through a work piece to engage, bend and clinch the legs of the staple such that they lie substantially flat against the underside of the work piece. However, stapler devices of this kind are typically loaded with staples of a size to suit a wide range of thicknesses of work piece, and as a result, if a thin work piece is stapled, the clinched legs will be much longer than for a thick work piece, and if the clinched legs are too long, they will overlap, which is undesirable.

SUMMARY OF THE INVENTION

PCT/US90/00492 teaches a clinching mechanism which overcomes this problem by using an anvil plate which includes a pair of parallel vertical slots that are arranged in side by side overlapping configuration for receiving the unclinched legs of a staple as they protrude from the underside of the work piece and guiding each leg into engagement with its associate clinching wing. The clinching wings are similarly offset from each other in the vertical plane so as to lie in side-by-side planes so that upon rotation of the clinching wings towards the work piece, each leg of the staple is bent into its associated slot and the two legs are brought to lie flat against the work piece parallel to each other, thereby allowing the legs to pass one another as necessary. The arrangement has the drawback, however, that there is a high likelihood that the legs might move laterally of the clinching wings during clinching, resulting in their overlapping and possibly even jamming the staple in the anvil plate, thereby preventing removal of the work piece from the stapling device. This problem is further exasperated due to the fact the overlap between the slots in the anvil plate must be large in order to accommodate for the wide variety of work piece thicknesses and resulting leg lengths, which could lead to a leg being received in the wrong slot.

U.S. Pat. No. 4,593,847 discloses a clinching mechanism which overcomes this problem by forming the slots in the anvil in parallel spaced apart arrangement and positioning a vertically extending plate between and parallel to the slots, which plate prevents the leg that engages in one slot from being clinched across the other slot. However, this system has the disadvantage that the clinched legs will be spaced apart from each other by at least the thickness of the plate.

Accordingly, there is a need for a clinching mechanism which prevents the legs of the staple from overlapping each other during the clinching operation without imposing a minimum separation between the clinched legs.

According to one aspect of the present invention, there is provided a clinching assembly for guiding and clinching a staple, comprising first, second and third plates arranged in a spaced apart stack with said second plate positioned between said first plate and said third plate, first clinching means located between said first plate and said second plate and operable, in use, to clinch a first staple leg received in a first slot formed by the space between said first plate and said second plate, and second clinching means located between said second plate and said third plate and operable, in use, to clinch a second staple leg received in a second slot formed in the space between said second plate and said third plate, wherein said first and third plates have at least one aligned edge forming an anvil surface of the clinching assembly, and said second plate is movable relative to said first and third plates between a first aligned position in which it has an edge aligned with said anvil surface so as to prevent interference between the staple legs as they engage in their respective slots, and a second retracted position in which said edge is withdrawn from said anvil surface so as, in use, to be at least partially retracted from between said inserted staple legs.

The present invention further provides a method of clinching a staple comprising the steps of inserting the staple legs through a work piece into a clinching assembly on opposite sides of a guide plate, at least partially retracting the guide plate from between the unclenched staple legs and then clinching the staple legs.

More particularly, the invention provides a method in which the face of an anvil composed of three spaced apart and stacked plates is driven against one side of a workpiece, a staple is pressed through from the other side of the work piece so that the legs engage in apertures on opposite sides of the middle of said stack plates which forms said guide plate, said guide plate is retracted relative to the side plates, clinching means are actuated to clinch the staple legs against the work piece, the anvil is withdrawn from the workpiece and the guide plate is returned to its original position relative to said side plates.

A clinching assembly and method of use thereof in accordance with the invention has the advantage that the legs of the staples are kept separated when they are inserted into the assembly by the second plate, thereby preventing interference therebetween and in particular preventing the possibility of their crossing over, whilst allowing the legs to be clinched into close alignment with each other and the crown of the staple, thereby resulting in a staple which is much more compact.

Preferably, the clinching means have clinching surfaces which cooperating with the staple legs to develop a camming action therewith that urges the legs laterally towards each other and the staple crown during clinching. In the preferred embodiment, this is achieved by making the clinching surfaces inclined towards each other, but they may also have curved surfaces or the like.

The distance through which the second plate should be moveable relative to the first and third plates, that is the distance between the aligned and the retracted positions of the second plate, is dependant upon the distance which the unclinched staple legs protrude through the work piece to be stapled. The second plate is retracted in order to allow the clinched staple legs to be pressed in close alignment with each other in the final stages of the clinching operation whilst still to be kept separate during the initial bending so as to prevent their overlapping. Accordingly, if the staple legs are particularly long, the second plate may be designed to be retracted further than if the legs are short, it being important merely that the clinched legs are closely aligned with the staple crown but not overlapping in the direction perpendicular to the staple crown. It has been found that a movement of the second plate of less than or equal to 3 mm provides acceptable results for a good range of staple sizes and work pieces.

The clinching means are preferably disposed in mirror image configuration on either side of the second plate and include clinching wings that are pivotally mounted to the first and third plates respectively and which have a curved surface against which an actuating lever associated with each clinching wing engages, each actuating lever pressing against said surface of its associated clinching wing to move it to its clinched position. The actuating levers are advantageously themselves pivotally mounted on their associated plates and are biased by torsion springs into operating engagement with their clinching wings.

Locking means may then be provided, preferably in the form of protrusions on the second plate, which restrain the actuating levers against the force of the biasing means so as to lock the clinching wings in their unclinched position. It is particularly advantageous for the locking means to be so realised as protrusions on the second plate which release the actuating levers to operate the clinching wings when the second plate is retracted, since automatic operation of the clinching wings is thereby achieved in a particularly simple and effective manner.

In the preferred embodiment, the clinching wings each have a lever arm that protrudes laterally from the plates and is engageable to rotate its clinching wings from its clinched to its unclinched position against the force of the biasing spring.

The plates are preferably generally rectangular and are biased into alignment with each other, preferably by means of a spring that engages simultaneously into apertures formed in the three plates that are aligned when the edges of the plates which form the anvil surface are aligned.

The plates are preferably slidably mounted in a housing by means of bushes that are slidable along bars fixed in the housing and which have studs that engage in openings in the plates. The second plate can then be made to be movable to a limited degree relative to the first and third plates in a particularly simple manner by constraining the first and third plates to move with the bushes by making their openings a tolerance fit on the studs and elongating the opening in the second plate to allow it to move to a limited degree relative to the bushes and hence the first and third plates. This arrangement provides a particularly simple anchoring system for the plates whilst still allowing the necessary intermovements between the plates for proper operation of the invention Other developments and advantages of the invention are provided below.

In order that the invention may be well understood, there will now be described an embodiment thereof, given by way of example, reference being made to the accompanying drawings, in which:

DETAILED DESCRIPTION OF THE INVENTION

Figure 1:
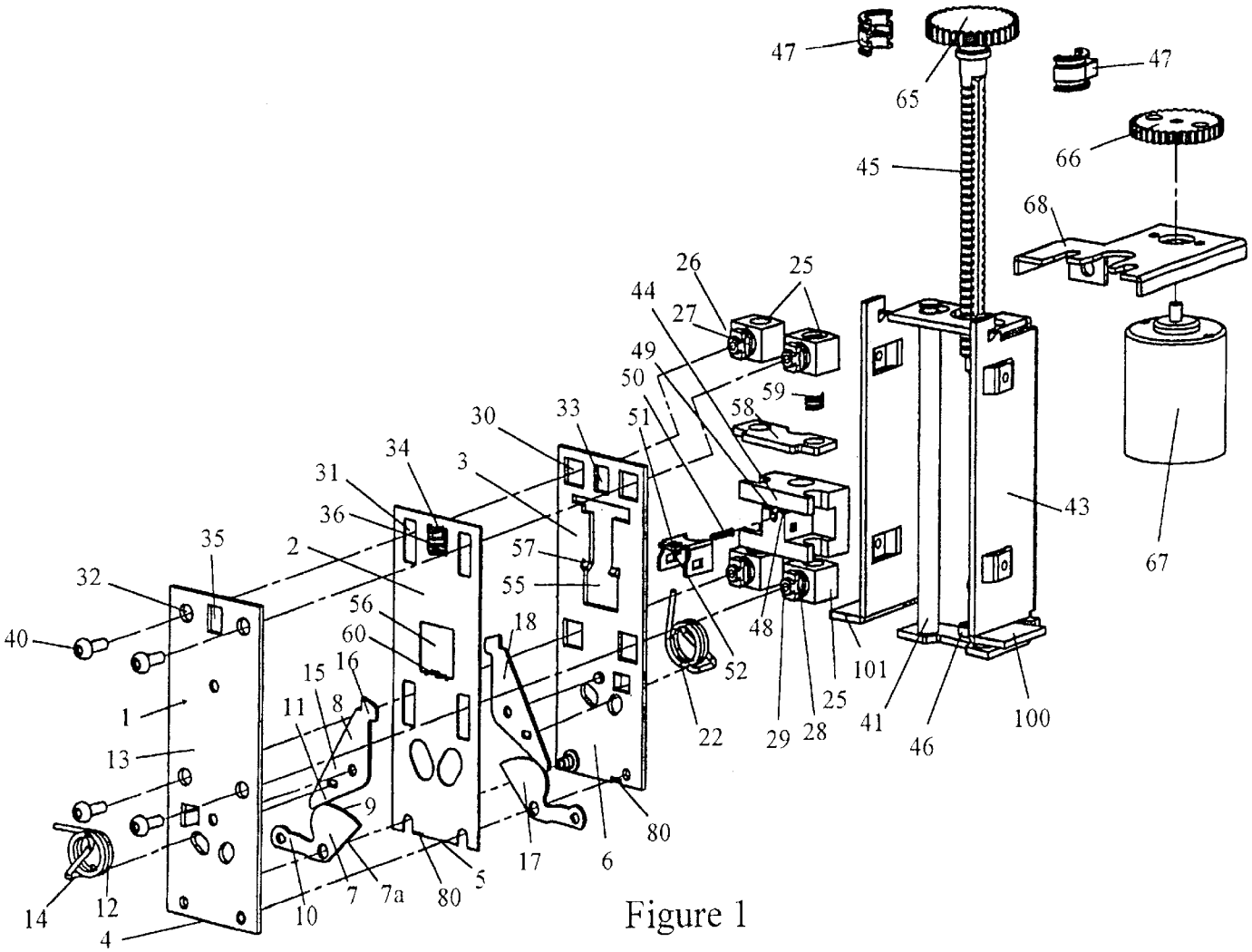
FIG. 1 is an exploded isometric view of a clinching mechanism according to the invention.
Figure 2:
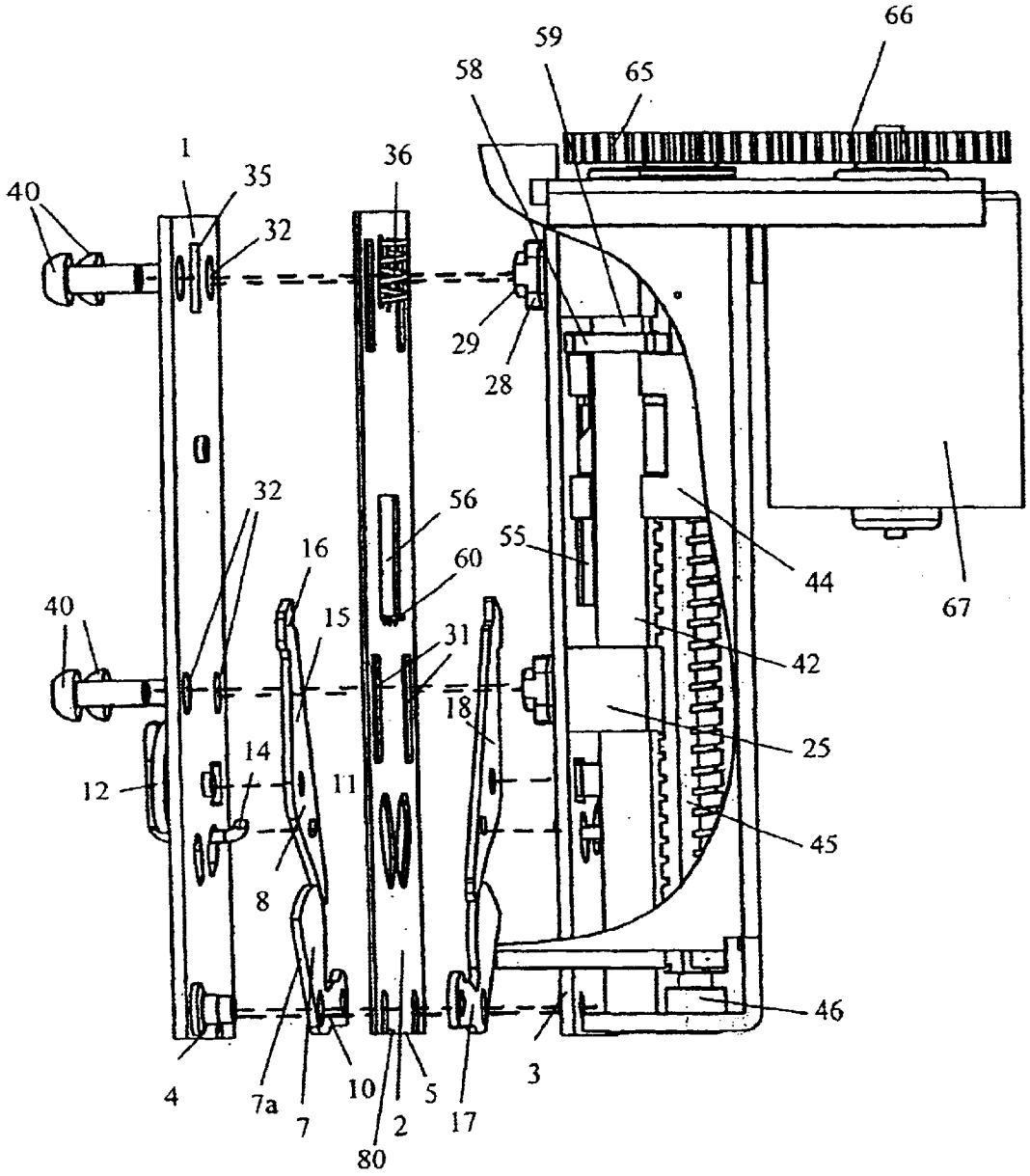
FIGS. 2 to 5 are exploded sectional side views of the mechanism of FIG. 1 at various stages during a clinching operation.
Figure 3:
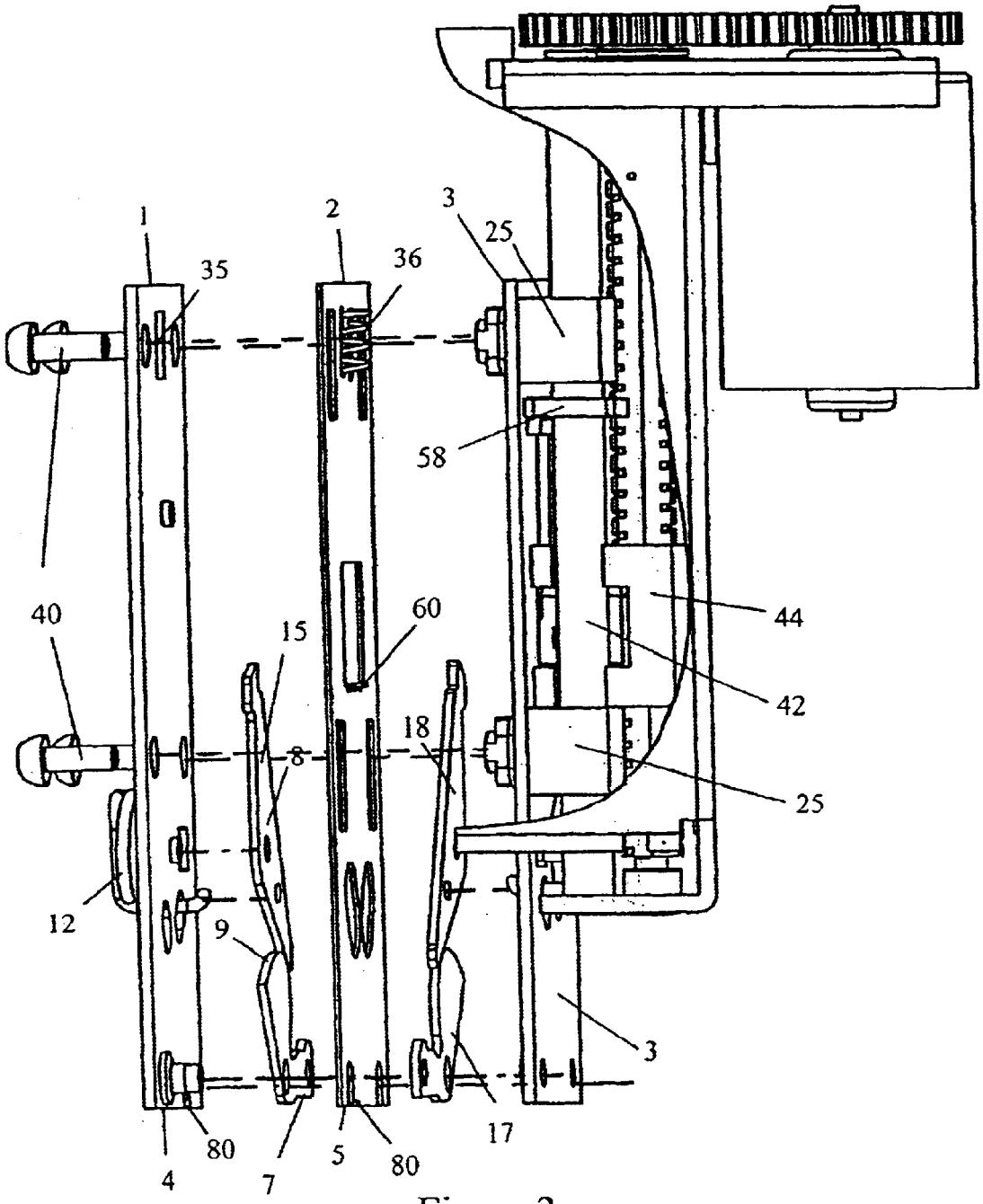
Figure 4:
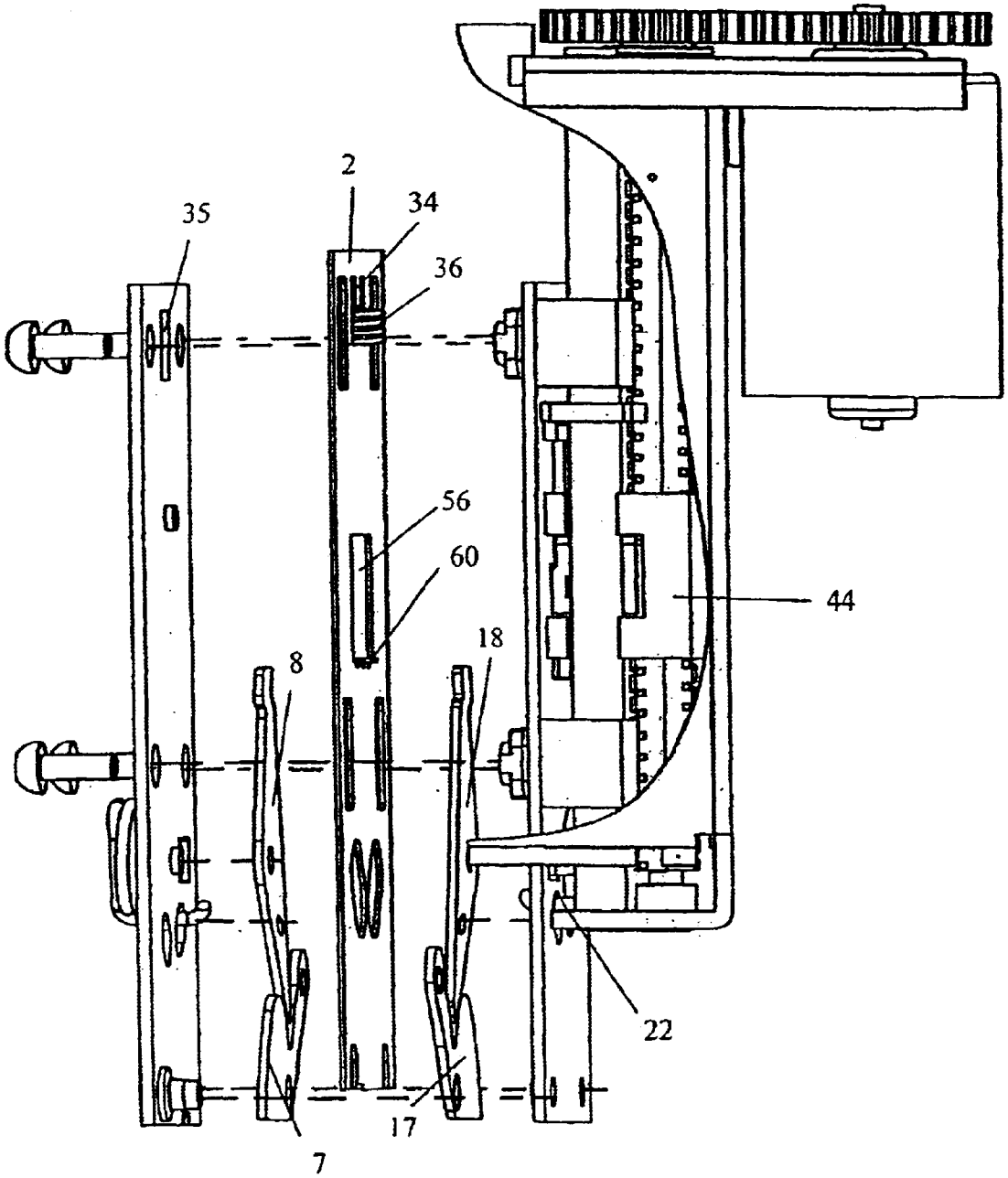
Figure 5:
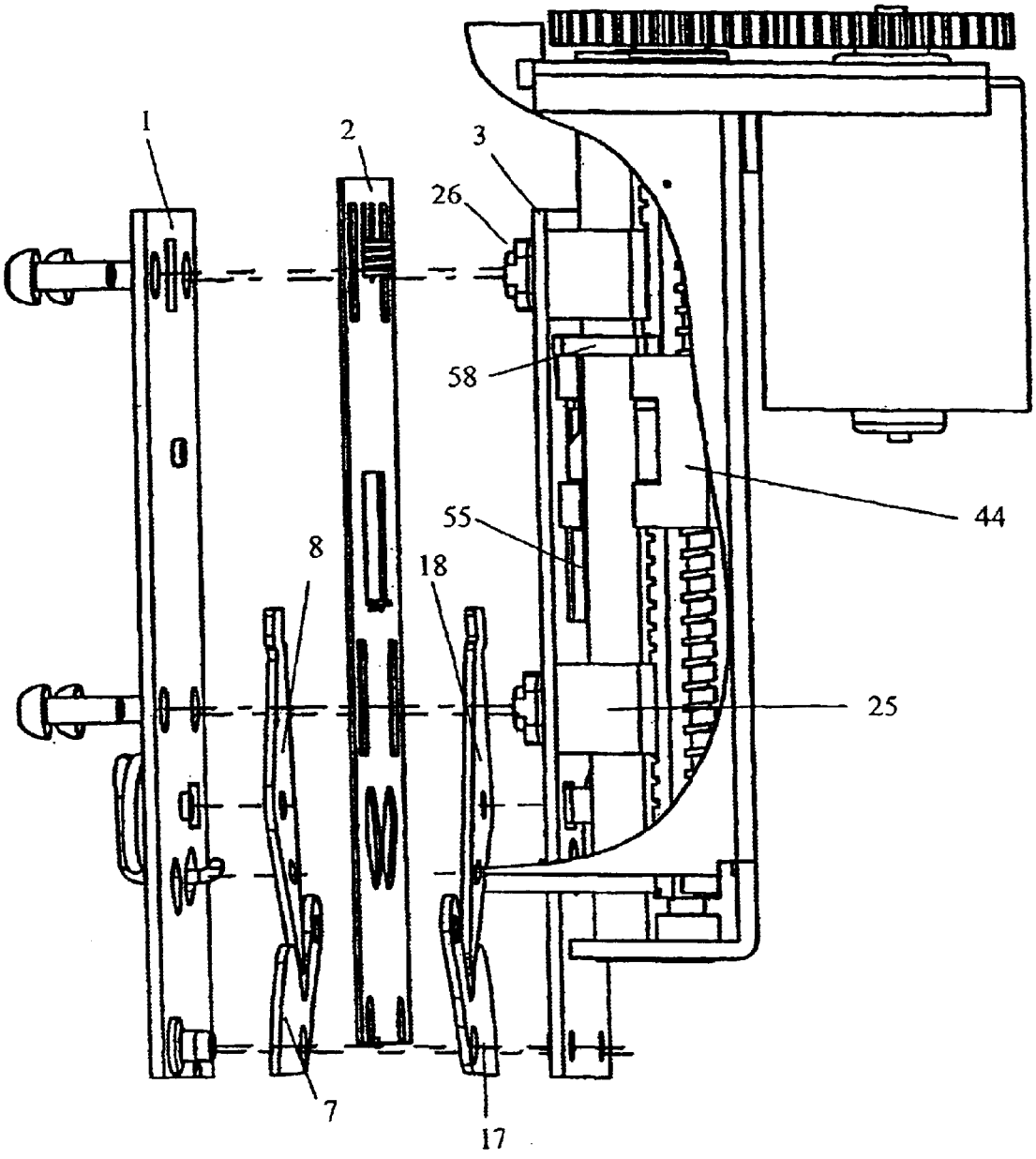

Referring first to FIG. 1, there is shown an exploded perspective view of a clinching mechanism for clinching the legs of staples and other similar fixing devices. The mechanism comprises three generally rectangular plates 1, 2, 3, stacked together in face to face relationship, the lower ends 4, 5, 6 of the three plates together forming an anvil face against which, in use, a stack of paper to be stapled is pressed during a clinching operation.

Pivotally mounted between the first plate 1 and the second plate 2, which acts as a guide plate during clinching in the manner described hereinafter, is a clinching wing 7 and an associated actuating lever 8 such that said plates 1, 2 are maintained in a spaced apart relationship, thereby creating a channel within which a leg of a staple can be received for clinching. The clinching wing 7 has formed on one lever arm a clinching face 7*a* which, in a first rotational position illustrated in FIG. 1, extends at an inclined angle to the lower ends 4, 5 of the first 1 and guide 2 plates and in a second rotational position illustrated, for example, in FIG. 22, extends substantially parallel to the lower ends 4, 5. Said one lever arm of the clinching wing 7 also carries a camming surface 9 on its side opposite to said clinching face 7*a* against which one lever arm 11 of the actuating lever 8 abuts so that, upon rotation of the actuating arm 8 against the clinching wing 7, the resulting camming action causes the clinching wing to rotation about its pivot point towards said second rotational position, whereby, in use, the clinching face 7*a* clinches the leg of a staple.

Figure 13:
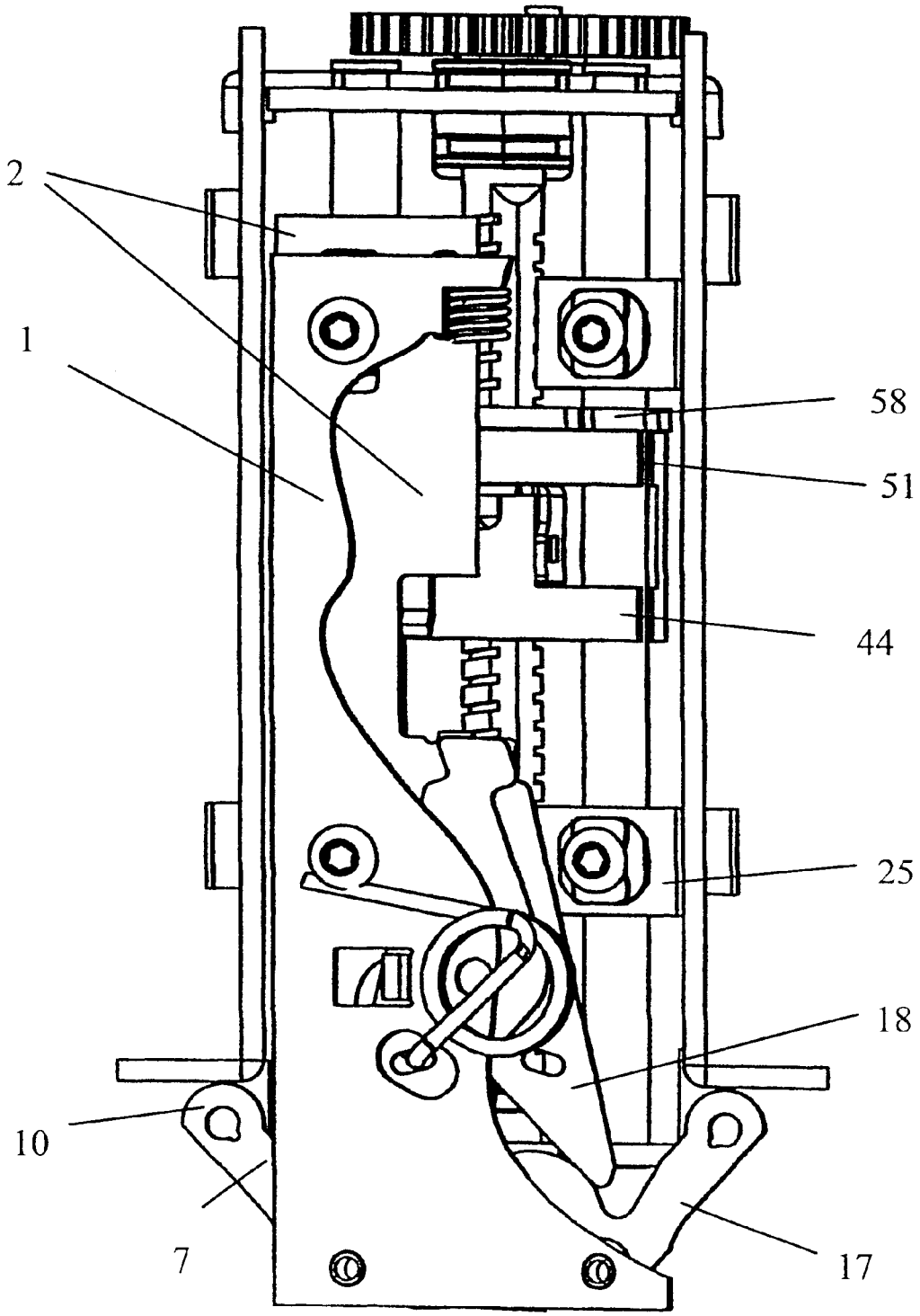

The clinching wing 7 also has a second lever arm 10 which extends along an axis that is inclined to the longitudinal axis of the clinching face 7*a* such that when the clinching face 7*a* is in its first position, it extends from a side flank of the plates 1, 2 substantially parallel to the anvil face formed by the lower ends 4, 5, 6 of the plates 1, 2, 3 and when the clinching face 7*a* is in its second position, its extends from said side flank at an inclined angle to said anvil face as shown, for example, in FIG. 13.

An actuating lever biasing spring 12 in the form of a torsion spring is mounted on the outer face 13 of the first plate 1 and engages the actuating lever 8 with a spring leg 14 so as to bias the actuating lever 8 against the camming surface 9 of the clinching wing 7 and hence bias the clinching wing 7 into its second position. The actuating lever 8 also has a second lever arm 15 on the end of which is formed a hook 16 that is engageable with a projecting lip 60 formed on the neighbouring face of the guide plate 2 in order to lock the actuating lever against rotation under the biasing load of the torsional spring 12 and hence to lock the clinching wing 7 in its first position.

A second clinching wing 17 and associated actuating arm 18 are pivotally mounted between the guide plate 2 and third plate 3 in a mirror image configuration to those mounted between the first plate 1 and guide plate 2 such that the first and second clinching wings 7, 17 overlap when in their second, clinched positions. A second biasing spring 22 is then mounted on the outer face of the third plate 3 which engages the second actuating arm so as to bias it into engagement with the second clinching wing 17, and a second projecting lip 60 is formed on the face of the guide plate 2 neighbouring the second actuating lever 18 which co-operates with a hook formed on the end of the latter in order to restrain the second actuating lever 18 against rotation under the loading of the biasing spring 22. Apart from the mirror image configuration, the second clinching wing 17, actuating lever 18 and biasing spring 22 are identical with those disposed between the first and guide plates 1, 2 and will not, therefore be described here in any further detail.

The three plates 1, 2, 3, each have four apertures formed in them by means of which they are fixed together and mounted on four mounting bushes 25, screws 40 securely fixing the plates 1, 2, 3 to the bushes 25. Each mounting bush 25 has a projecting stud 26 composed of three distinct portions having difference cross-sectional shapes, a root portion 27, an intermediate portion 28 and an end portion 29. The root portion 27 has a substantially square cross-section that engages in the apertures 30 in the third plate which are of complementary size and shape to the root portion so that the third plate 3 is constrained to move with the bushes 25. The end portions 29 have a circular cross-section and are engage by the apertures 32 formed in the first plate, which, as with the third plate, are of complementary size and shape to the end portions of the studs such that the first plate is constrained to move with the bushes 25. In contrast, the apertures 31 in the guide plate 2 in which the intermediate portions 28 of the studs 26 engage are elongated as compared with the cross-sectional shape of the intermediate portions 28 so as to achieve a lost motion coupling in the longitudinal direction between the guide plate and the bushes 25. In this way, when mounted on the bushes, the guide plate 2 is slidably movable relative to the bushes 25, and hence relative to the first 1 and third 3 plates, through a limited distance of preferably no greater than 3 mm between a first position in which the top and bottom edges of the three plates 1, 2, 3 are aligned and a second position in which the upper edge of the guide plate is raised above the corresponding edges of the first and third plates 1, 3, and the bottom edge 5 is withdrawn between the first and third plates.

The three plates 1, 2, 3 each also include a spring mounting aperture 33, 34, 35, the three apertures 33, 34, 35 being in alignment when the top and bottom edges of the three plates are aligned and having mounted in them a compression spring 36 which engages against the top and bottom edges of the spring mounting apertures 33, 34, 35 so as to urge the three plates 1, 2, 3 into alignment.

The bushes 25 are slidably mounted on guide bars 41, 42, only one of which is visible in FIG. 1, which are carried in a housing 43 that has an open front in which the plates 1, 2, 3 are mounted. The bushes are separated into an upper pair and a lower pair that are spaced apart vertically as illustrated in FIG. 1 and slidably mounted on the guide bars 41, 42 between the upper and lower bushes 25 is a slide bar 44 that is drivable longitudinally along the guide bars between the upper and lower bushes 25 by a worm gear 45 which extends longitudinally through the housing 43 parallel to the guide bars 41, 42 and is rotatably mounted therein by means of bearings 46, 47. The worm gear 45 carries a spur gear 65 on its end that meshes with a pinion gear 66 mounted on the drive shaft of a motor 67, the motor being operable to rotationally drive the worm gear 45. The motor is mounted on a mounting plate 68 that is fixed to the housing 43.

Formed in the front of the slide bar 44 is a slot 48 in which is slidably mounted a lifting bracket 51 which cooperates with the guide plate 2 in order to move it relative to said first and third plates 1, 3 against the loading of the spring 36 in the manner described below. A hole 49 is also formed in the front of the slide bar 44 adjacent the slot 48 in which is mounted a compression spring 50 that engages between the slide bar 44 and the lifting bracket 51 in order to bias the latter out of the slot 48 towards the plates 1, 2, 3.

The third plate 3 has a generally 'T' shaped aperture 55 formed therein, the bottom of which is enlarged to allow a forwardly projecting panel 52 of the lifting bracket 51 to protrude through the aperture 55 in the third plate 3 and engage in a generally rectangular lifting aperture 56 formed in the guide plate 2. The apertures 55 and 56 are respectively positioned in the third and guide plates 3, 2 such that when the three plates 1, 2, 3 are aligned with each other the lower sides of the apertures 55, 56 are also aligned. The enlarged bottom portion of the 'T' shaped aperture 55 is, however, slightly longer than the lifting aperture 56 formed in the guide plate 2 such that as lifting bracket 51 is moved upwards away from the anvil face by the slide bar 44, it engages the upper edge of the lifting aperture 56 before it reaches the constriction in the 'T' shaped aperture. Upon further upward movement of the lifting bracket 51, the guide plate 2 is then carried upwards with the lifting bracket 51 from its first aligned position towards its second position.

Figure 6:
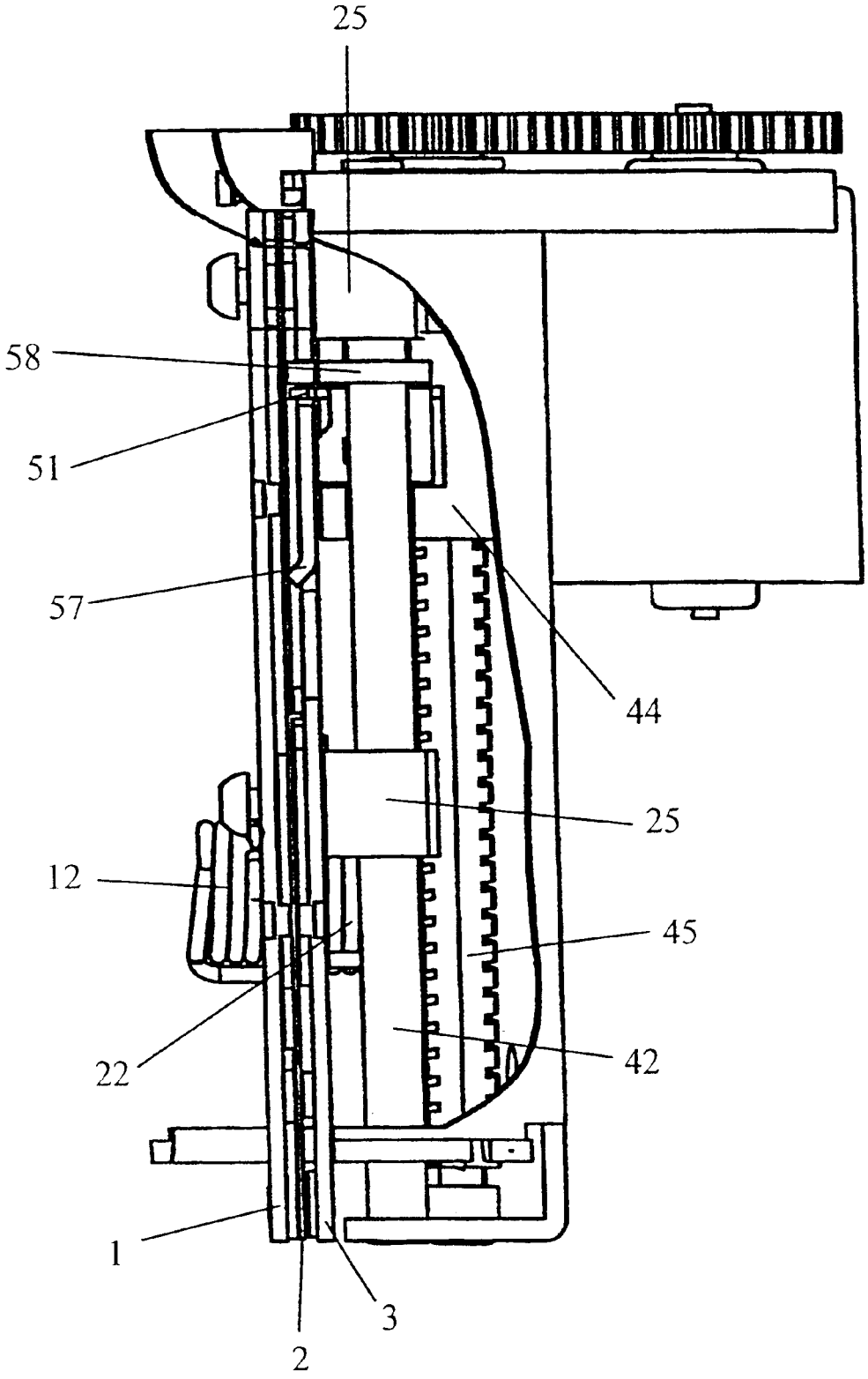
FIGS. 6 to 9 are cut away side views of the mechanism of FIG. 1 at the various stages during the clinching operation shown in FIGS. 2 to 5 respectively.
Figure 7:
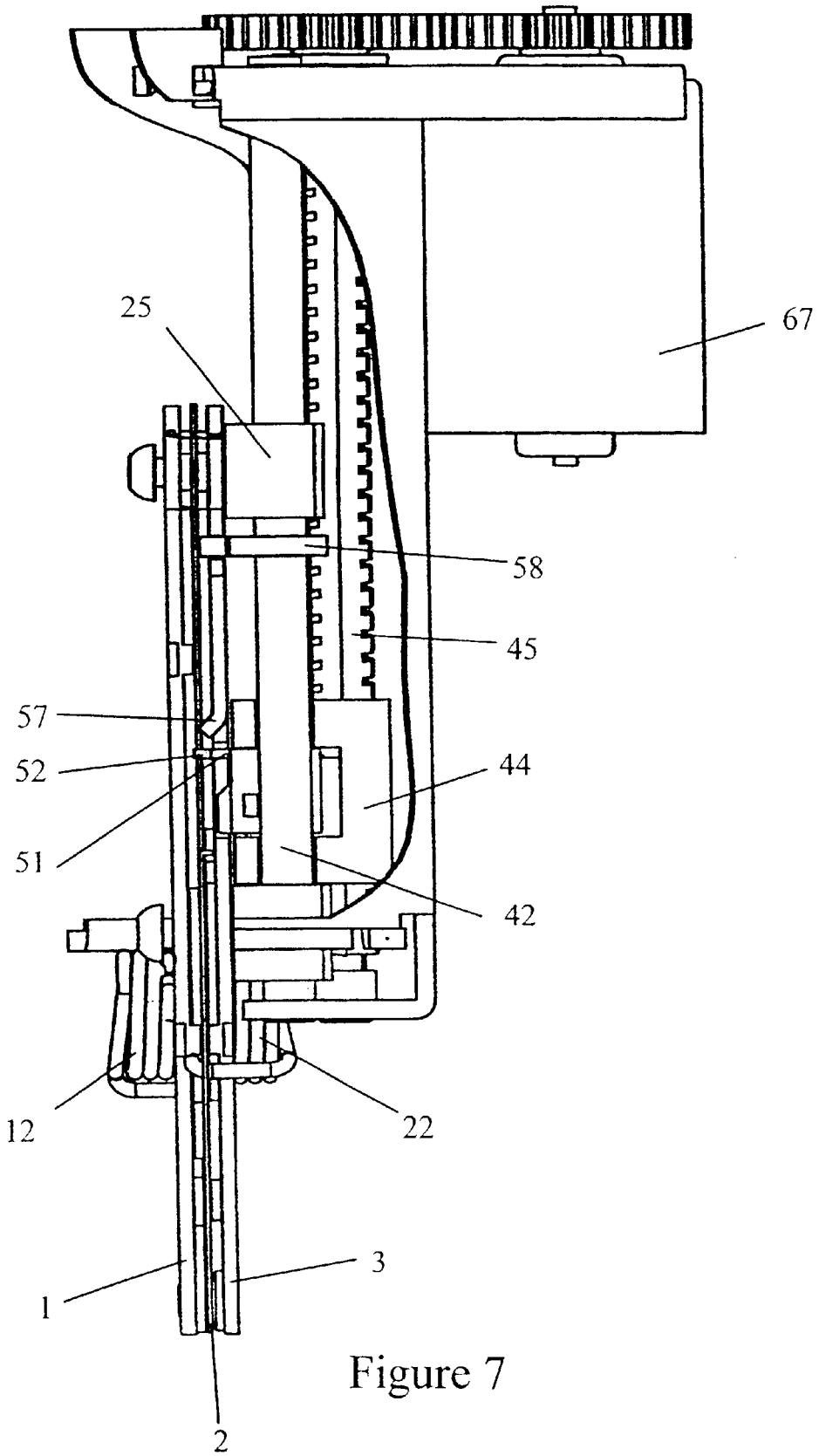
Figure 8:
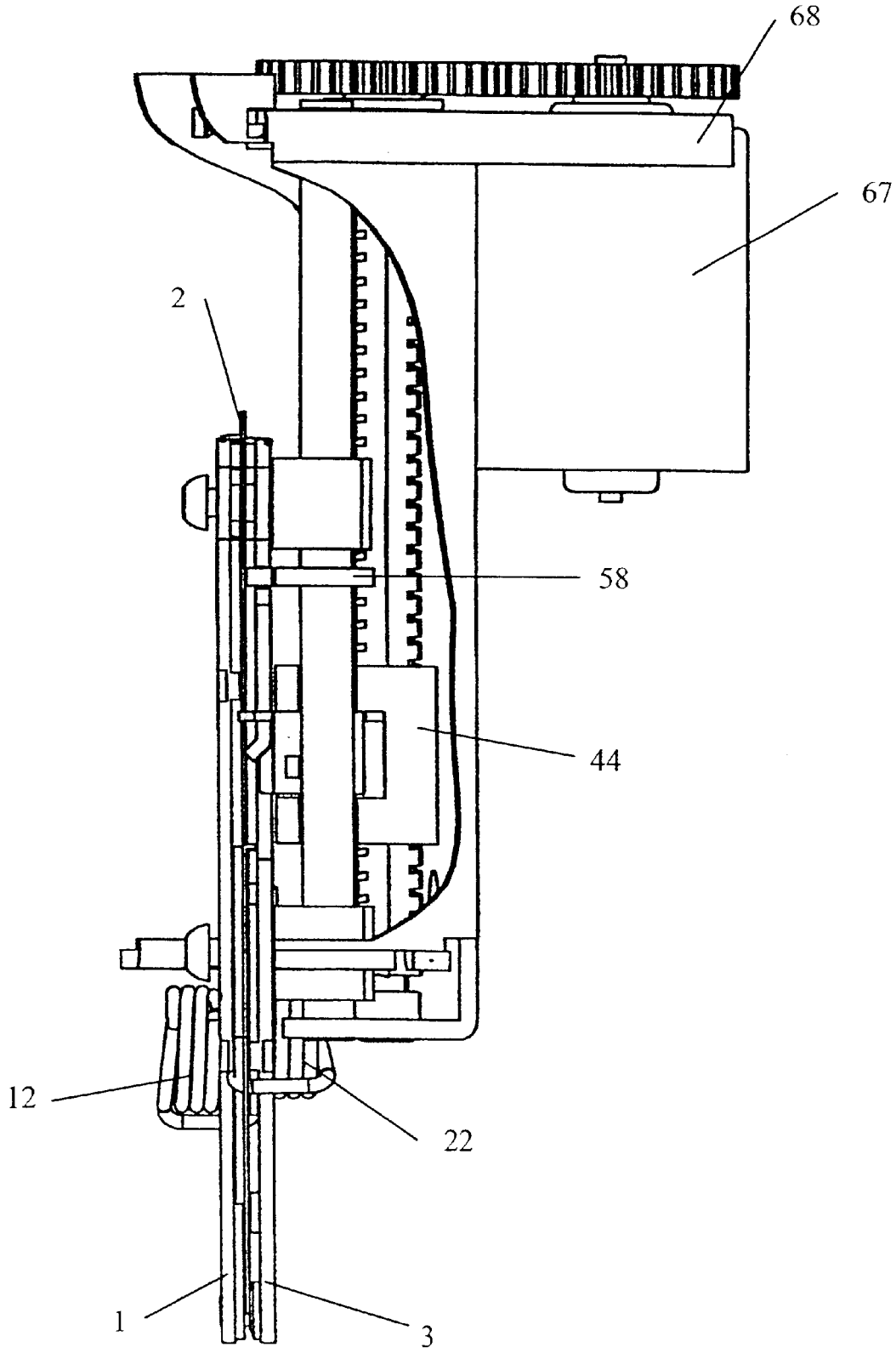
Figure 9:
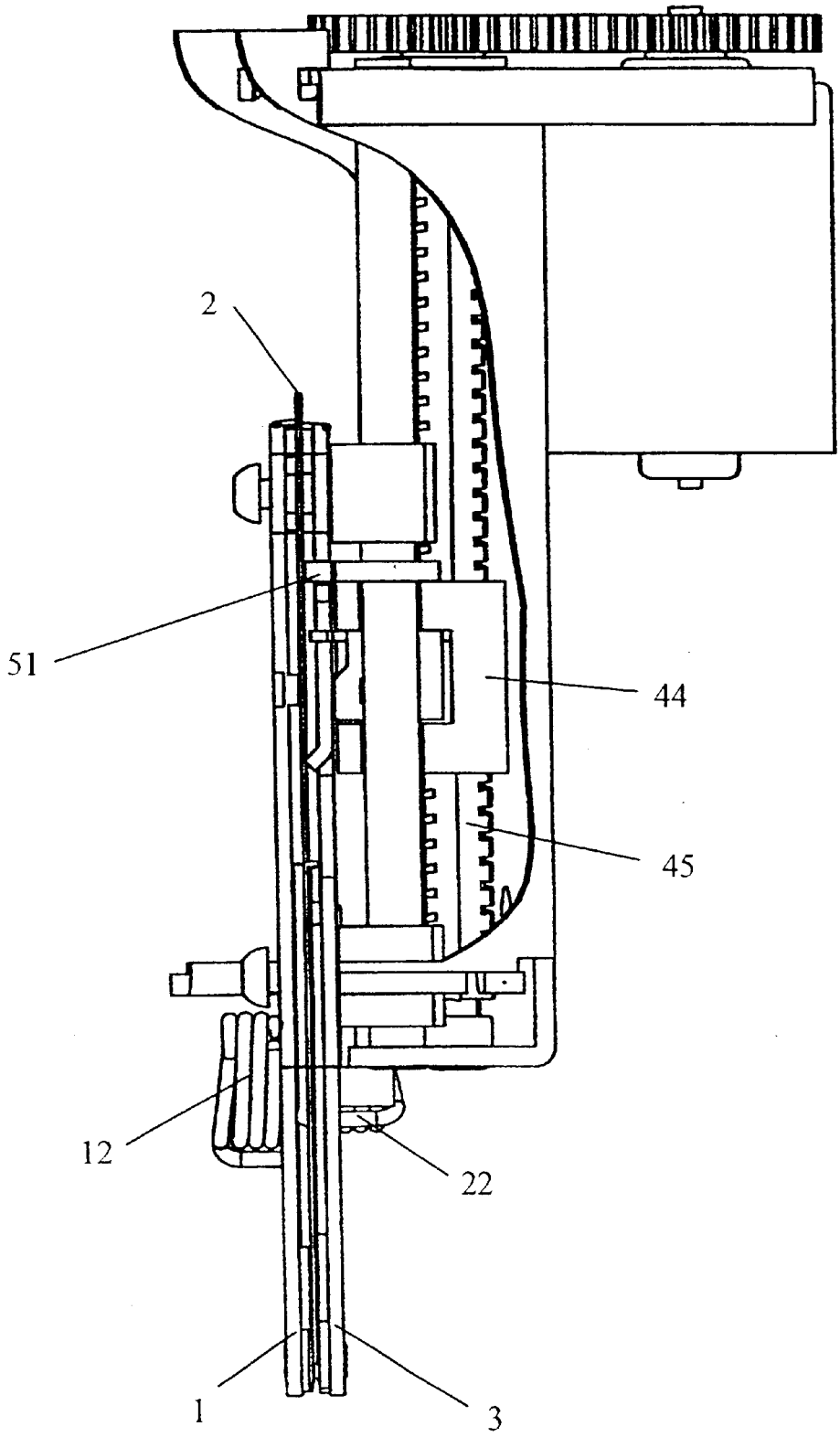
Figure 10:
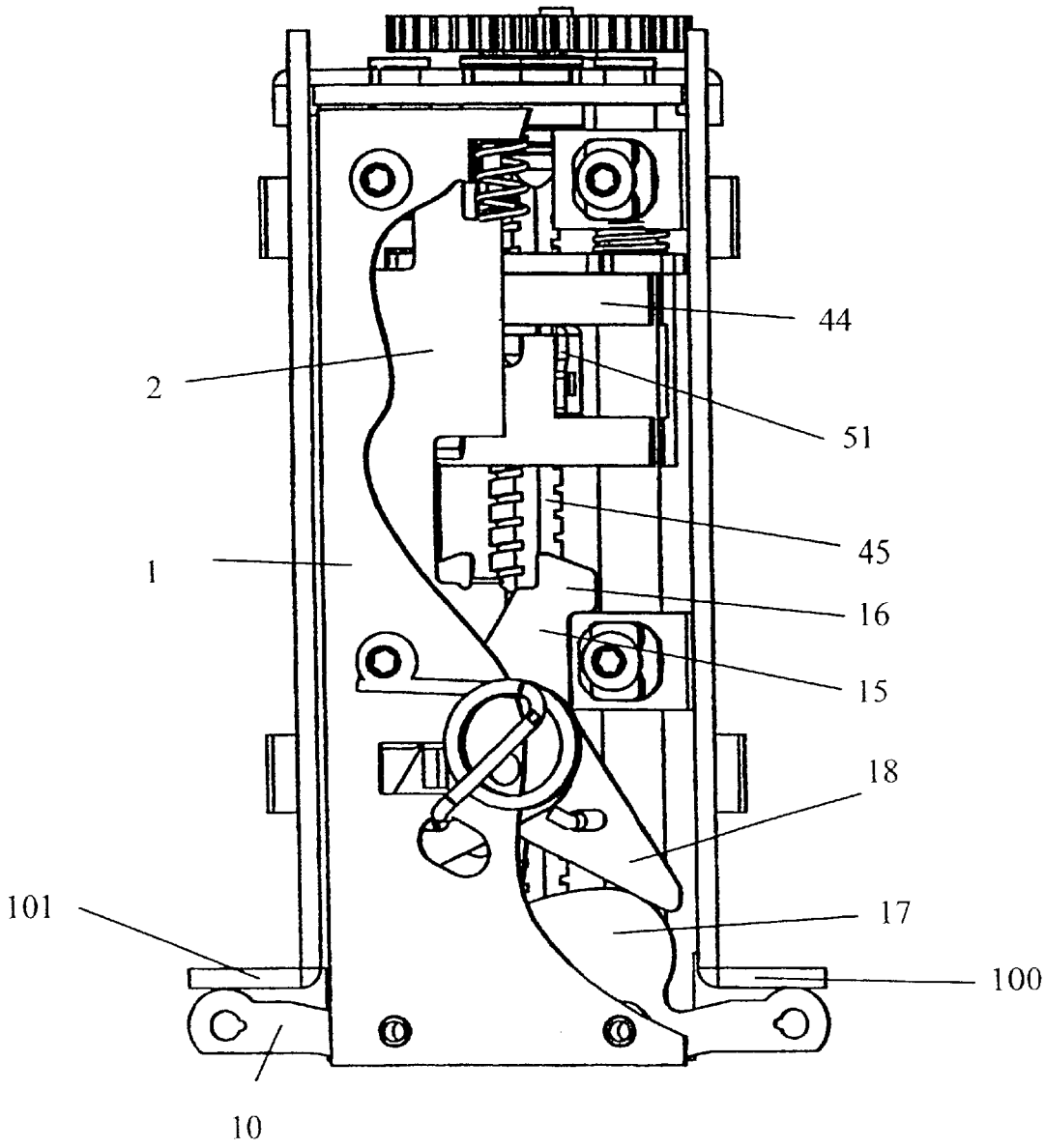
FIGS. 10 to 14 are partially cut away front views of the mechanism of FIG. 1 at the various stages during the clinching operation.
Figure 11:
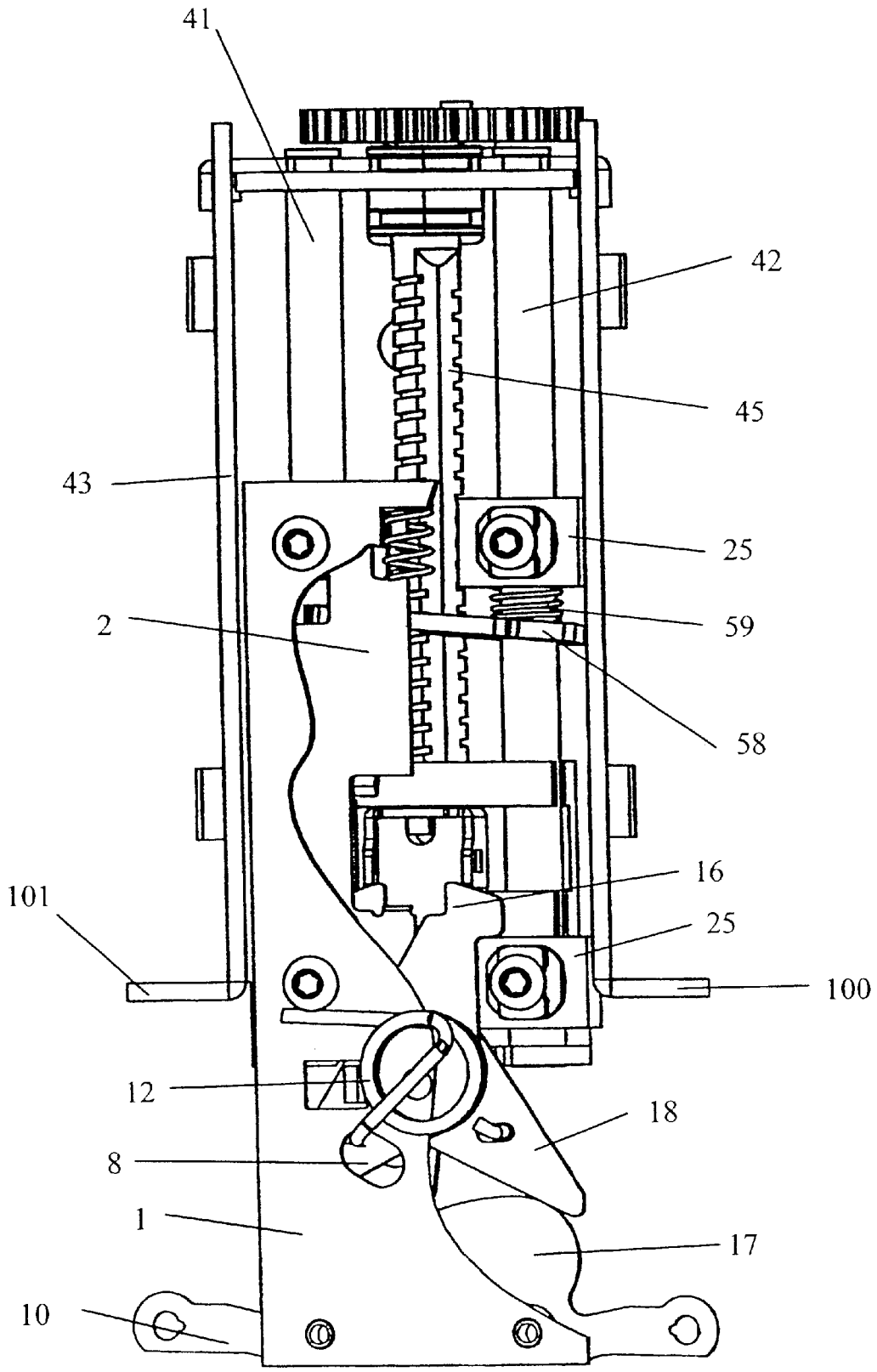
Figure 12:
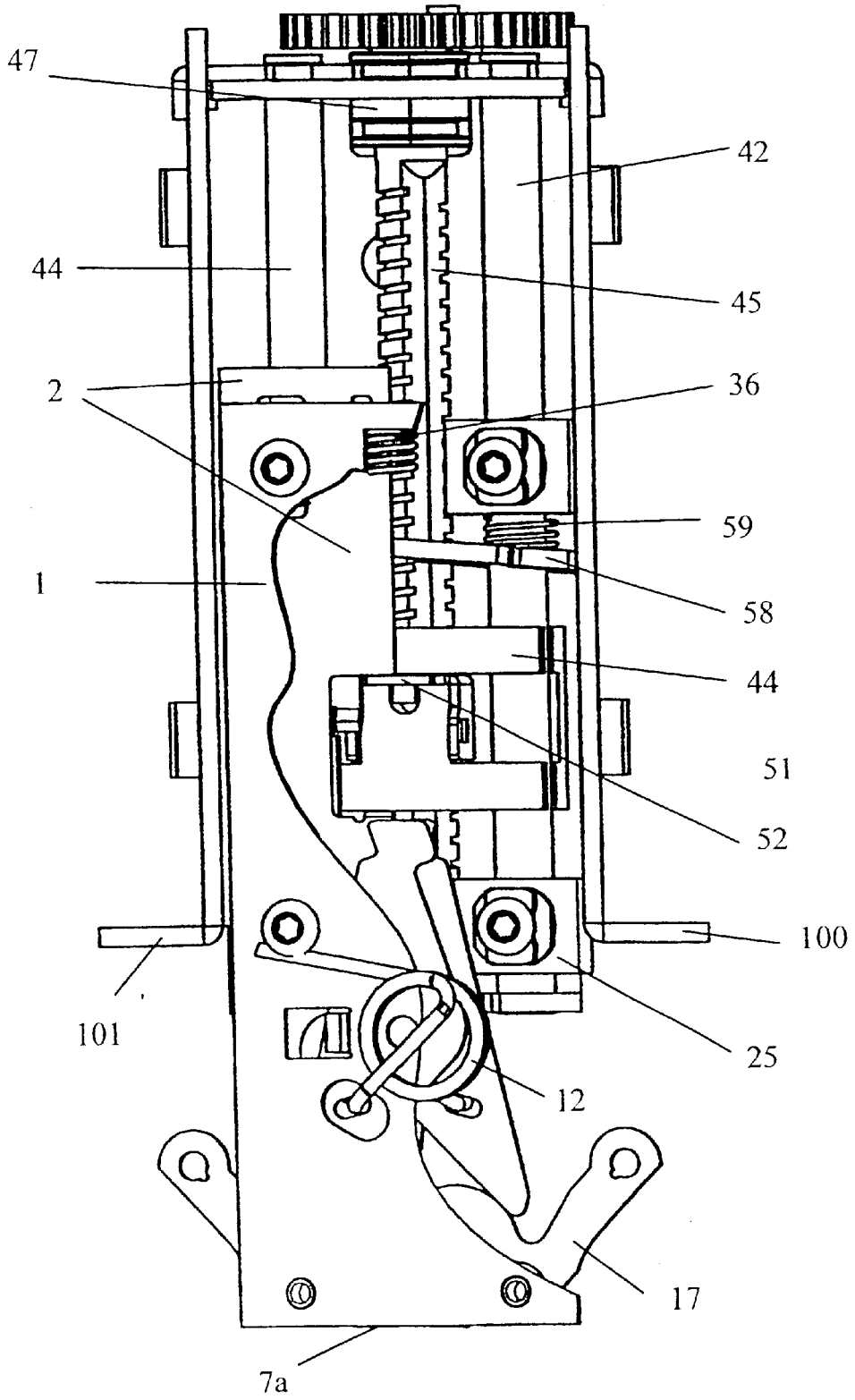

As illustrated more clearly in FIG. 6, the enlarged bottom part of the 'T' shaped aperture includes, at its upper end, ramp portions 57 which are inclined downwardly and towards the guide plate 2. As the upwards movement of the lifting bracket 51 continues, these ramp portions engage flank portions formed on the bracket 51 and the resulting camming action causes the bracket 51 to be pressed towards the slide bar 44 against the force of the biasing spring 50 whereupon the lifting bracket 51 is disengaged from the lifting aperture 56 thereby de-coupling the guide plate 2 from the slide bar 44, and the lifting bracket 51 is able to continue to move upwards with the slide bar 44 along the 'T' shaped aperture independently of the guide plate 2 and the third plate 3.

Also slidably mounted on the guide bars 41, 42 between the upper bushes 25 and the slide bar 44 is a locking plate 58 which has a projecting portion that engages in an upper part of the 'T' shaped aperture 55 so as to constrain the third plate 3 for movement with the locking plate 58. A locking spring 59, which takes the form of a compression spring, is mounted on one of the guide bars 41, 42 between one of the upper bushes 25 and the upper surface of one side of the locking plate, the loading of which spring 59 urges the locking plate 58 into an inclined position on the slide bars 41, 42. The tolerance between the locking plate 58 and one of the slide bars 41, 42 is closer then with the other slide bar, so that in the inclined position, the locking plate frictionally engages the surface of said one guide bar 41, 42, restraining it, and hence the first 1 and third 3 plates from longitudinal movement. Whilst it is preferred that the locking plate only grips one of the slide bars 41, 42 when tilted, it is also possible that the locking plate 58 could instead be made to grip both slide bars 41, 42.

The operation of the clinching mechanism will now be described in connection with FIGS. 2 to 26.

FIG. 6 shows the mechanism in its reset position ready for the next clinching operation in which the three plates 1, 2, 3 are all aligned with the hooks 16 on the actuating arms 8, 18 engaging against the projecting lips 60 on the guide plate 2, thereby retaining the clinching wings 7, 17 in their first, unclenched positions. The plates 1, 2, 3 are furthermore in their upper most positions by virtue of the upper pair of bushes 25 being retained in position at the upper limit of their travel along the guide bars 41, 42 by the slide bar 44 which has been driven to the top of the housing by the worm gear 45 into abutment with the locking plate 58.

Figure 20:
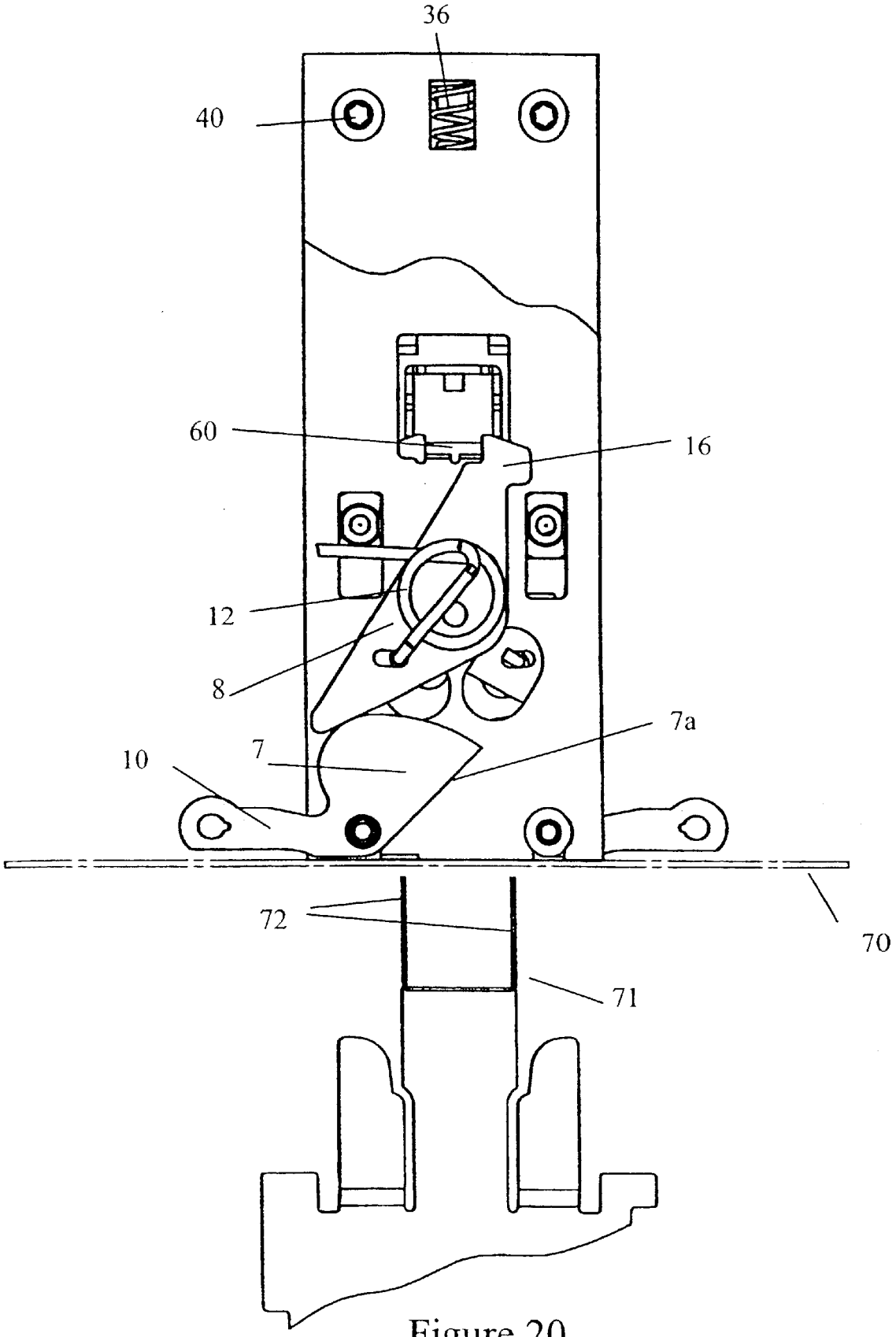
FIGS. 20 to 22 are cut away front views of the clinching mechanism of claim 1 showing the mechanism in three different positions during the clinching of a staple which is used to fix a thin work piece.

Upon initiation of a clinching operation, the motor 67 is operated to rotate the worm gear 45 which, in turn, drives the slide bar 44 downwards along the guide bars 41, 42 towards the lower pair of bushes 25. As the slide bar 44 travels past the enlarged bottom portion of the 'T' shaped opening, the lifting bracket 51 is pressed away from the slide bar 44 by the spring 50 so that its forwardly projecting panel 52 protrudes into the apertures 55, 56 in the third and guide plates. The slide bar 44 continues to be driven downwards by the motor 67 whilst the plates 1, 2, 3 and bushes 25 remain stationary until the bar 44 reaches and engages the lower pair of the bushes. The slide bar 44 then pushes the lower bushes 25 downwards on the guide bars 41, 42, which, in turn, drive the plates 1, 2, 3, which are constrained to move with the bushes (the second plate 2 is at this stage positioned with the studs at the lower end of the apertures 31). The assembly is hence translated into the position shown in FIGS. 3, 7, 11 and 15 in which, in use, the anvil plate formed by the lower edges of the three plates 1, 2, 3 is pressed against a stack of papers which are to be stapled. Since, at this stage, the anvil assembly composed of the three plates, the clinching wings and accompanying parts have moved as a single assembly, the hooks 16 on the actuating arms 8, 18 remain in engagement with the projection lips 60 on the guide plate 2 so that the clinching wings 7, 17 remain in their first positions as shown in FIG. 20.

Figure 21:
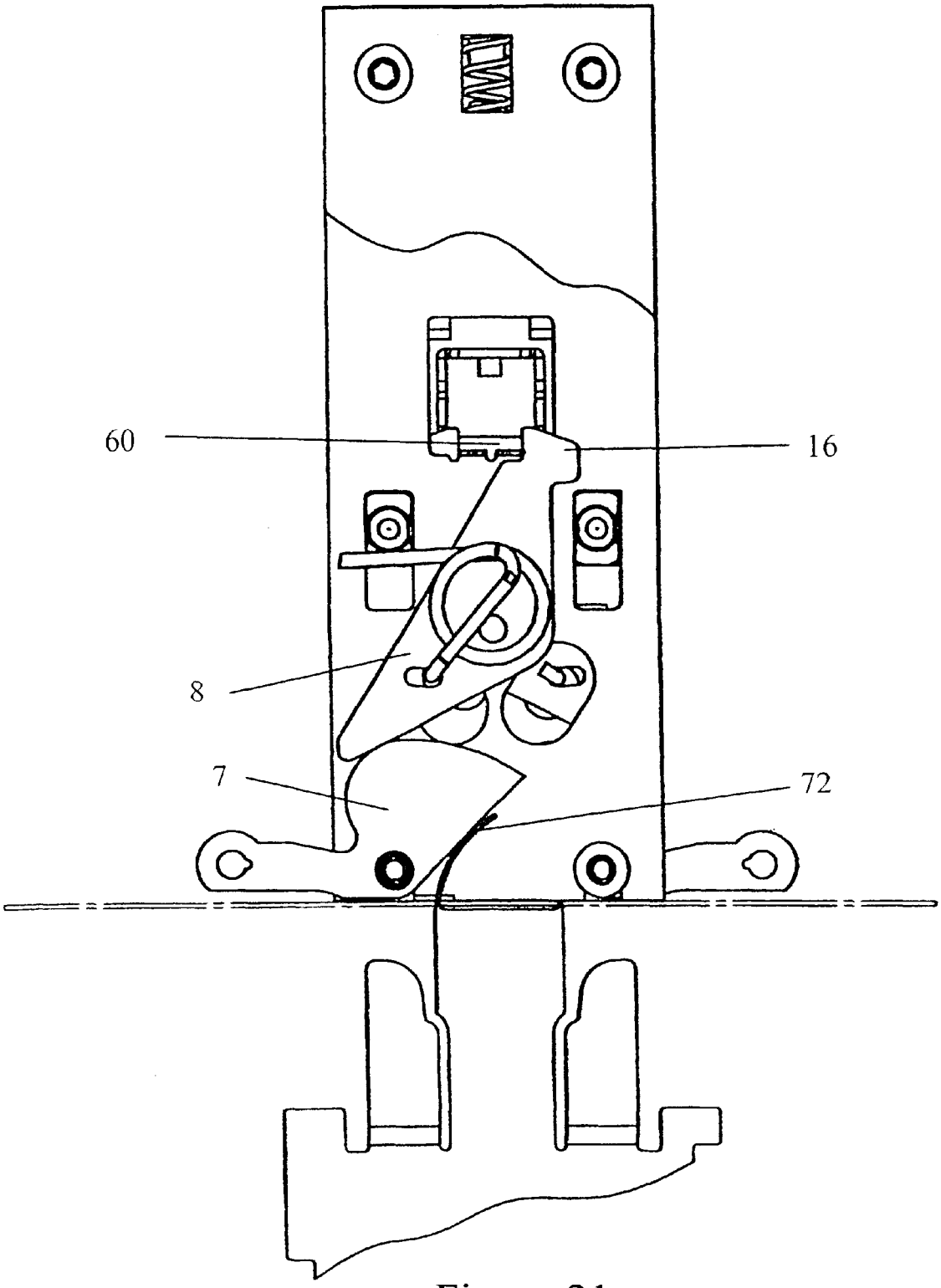
Figure 24:
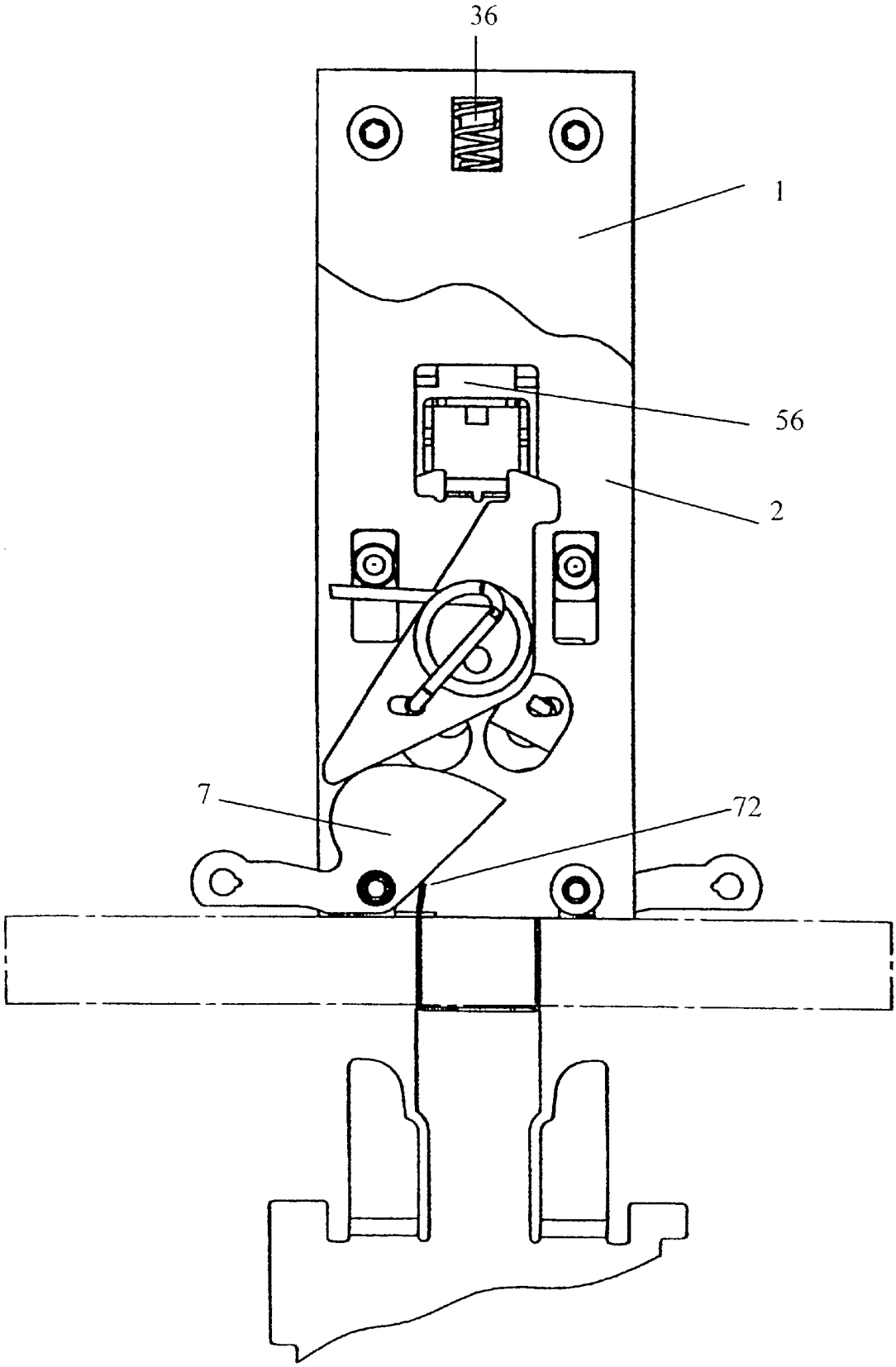
Figure 25:
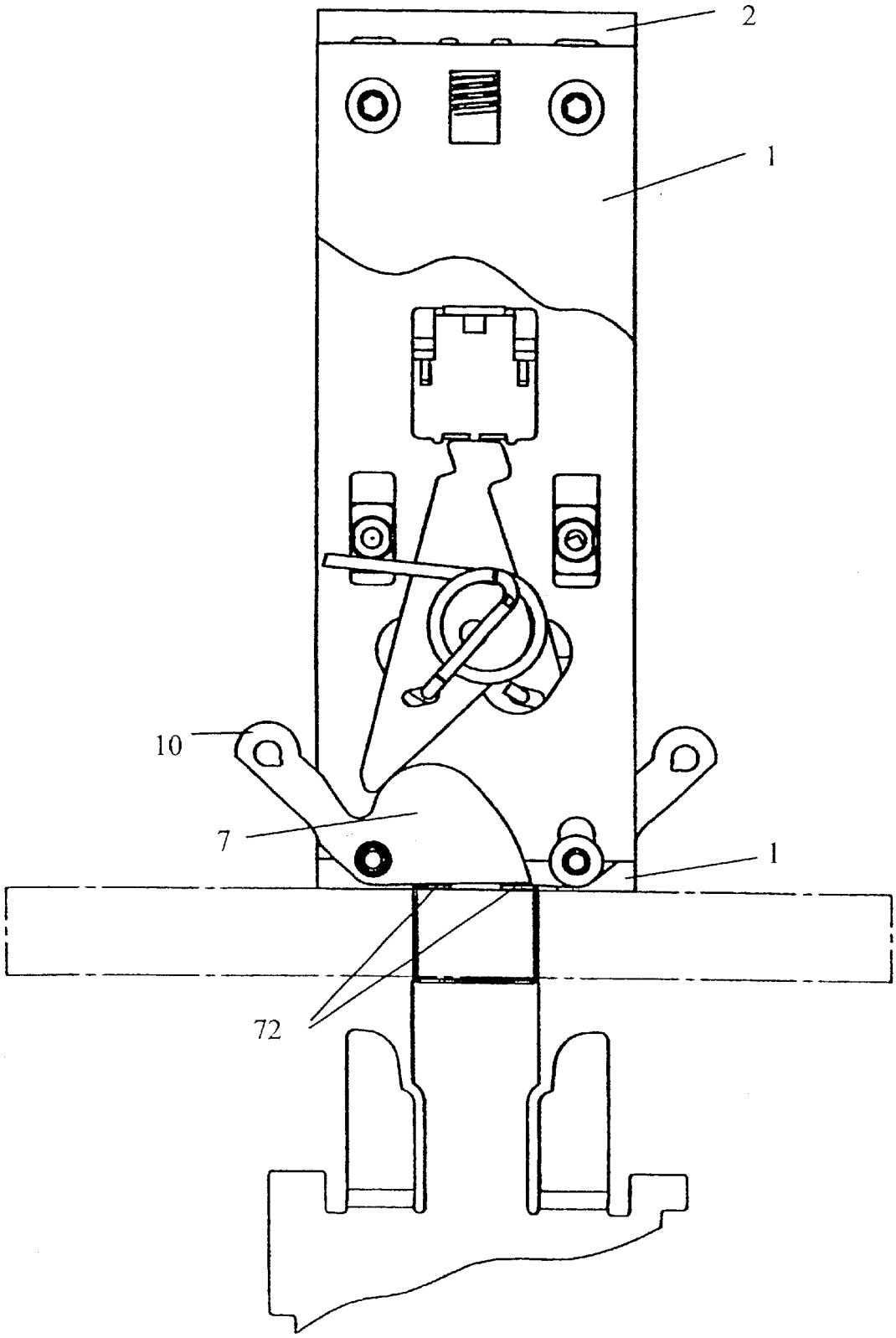

Once the anvil plate is pressed against the stack of papers 70, a staple 71 is pressed through the papers by a stapling head in a manner which is well known in the art and which will not, therefore, be explained here in detail. As the two staple legs 72 pass through the paper, they engage in the spaces formed on either side of the guide plate 2 and are guided towards the clinching surfaces of the first and second clinching wings respectively. The clinching wings 7, 17 are still in their first, unclinched positions at this stage, but, depending on the lengths of the staple legs 72 and the thickness of the stack of papers 70, the tip of each staple leg 72 may still engage the clinching surface of its associated clinching wing and be bent towards its clinched position as shown in FIGS. 21 and 24.

Once the staple is fully inserted through the stack of papers, the direction of the motor 67 is reversed so that the slide bar 44 is driven upwards in the housing 43 along the guide bars 41, 42 carrying the bracket 51 with it. As the slide bar 44 travels upwards, the projecting panel 52 of the bracket slides along the apertures 55, 56 in the guide and third panels until it reaches the upper edge of the lifting aperture 56. At this stage, continued upward movement of the slide bar 44 cause the bracket 51 to lift the guide plate 2 with it, moving it from its first position to its second position, which is preferably a distance of less than or equal to 3 mm, against the loading of the biasing spring 36. The first 1 and third 3 plates remain stationary, however, due to the locking plate 58, to which, as described above, the third plate 3 is locked, being restrained against movement along the guide bars 41, 42 by the friction arising from the inclined position it takes up on the guide bars 41, 42 as a result of the loading of the spring 59.

Figure 17:
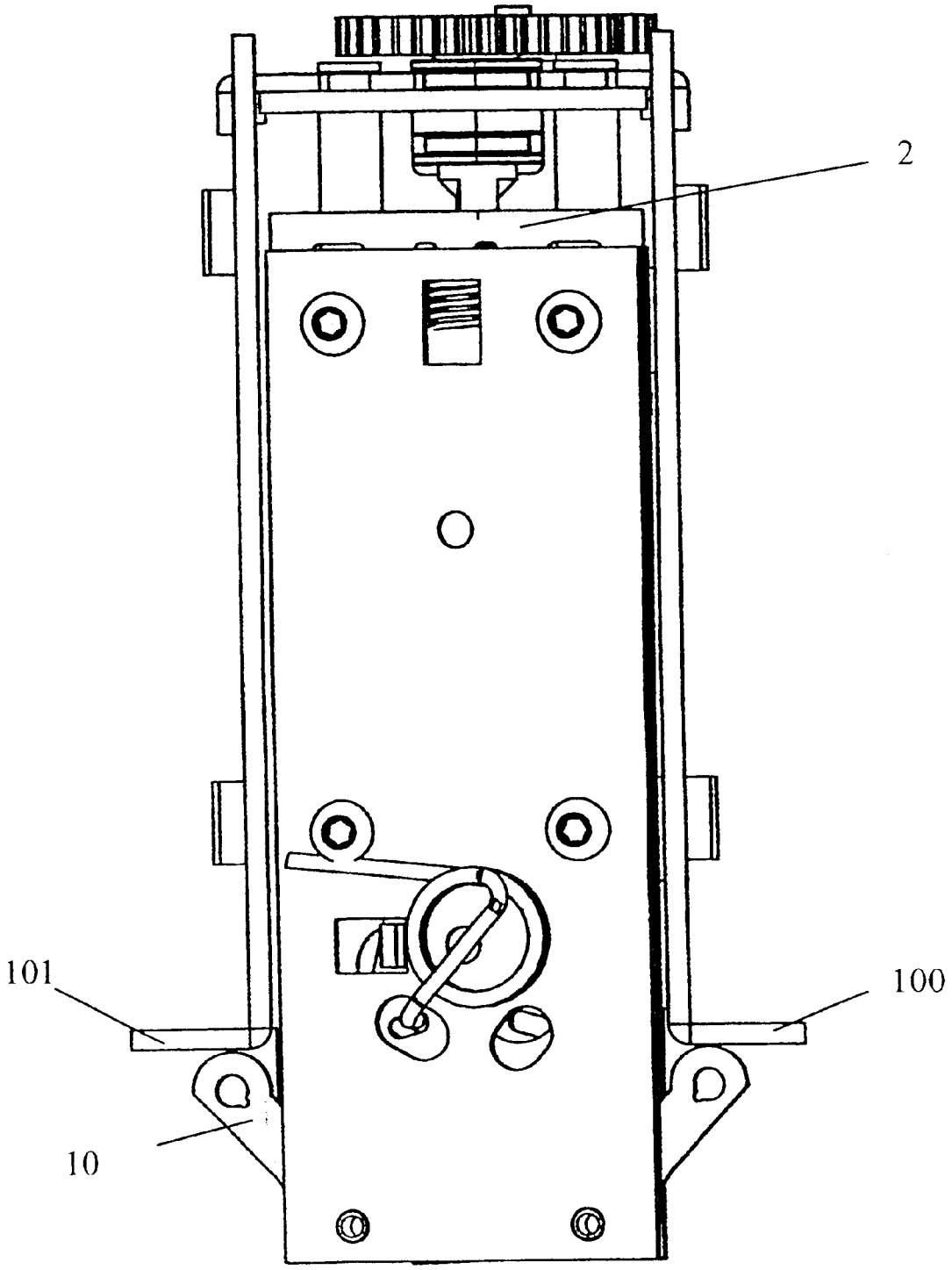
Figure 18:
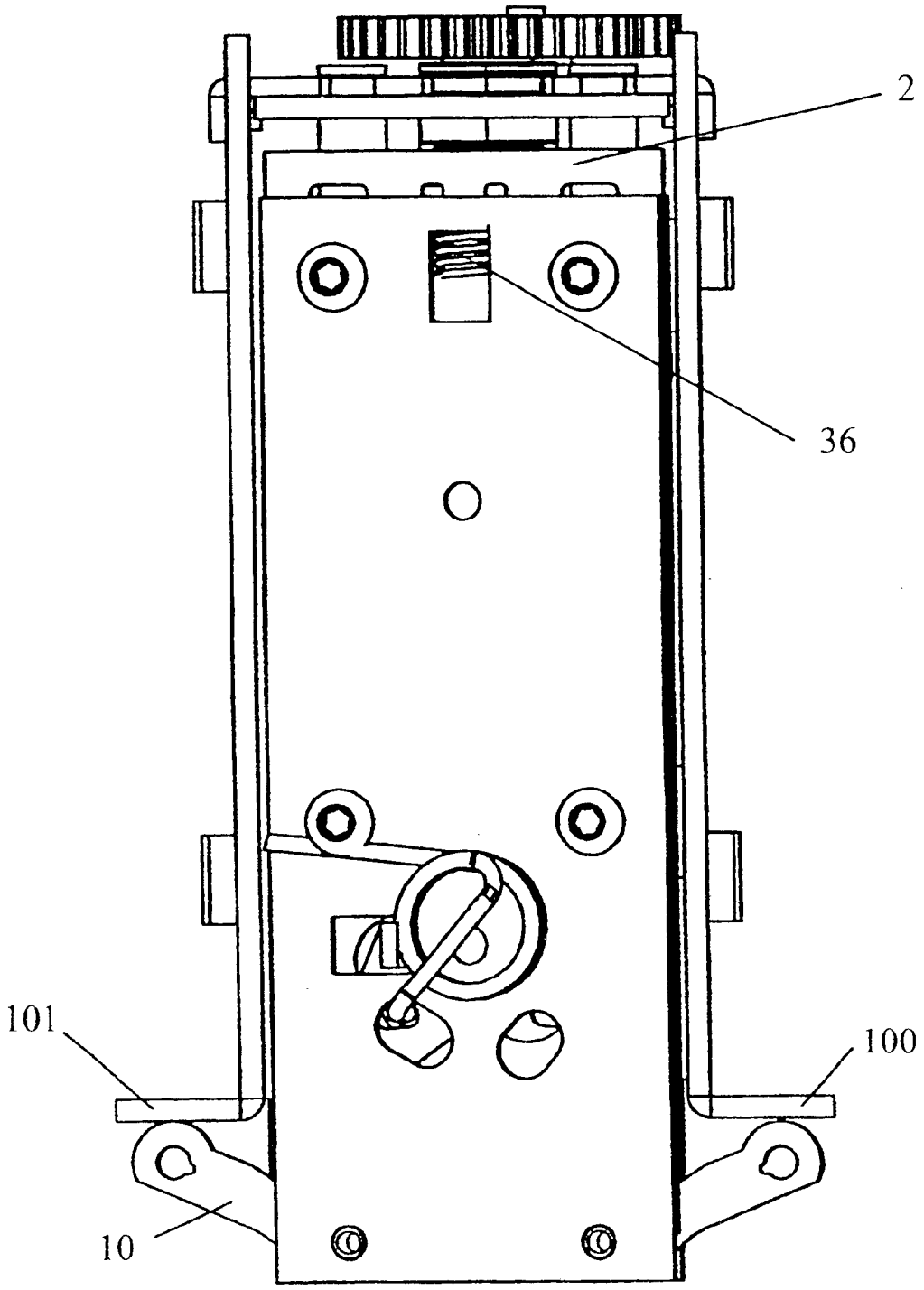
Figure 19:
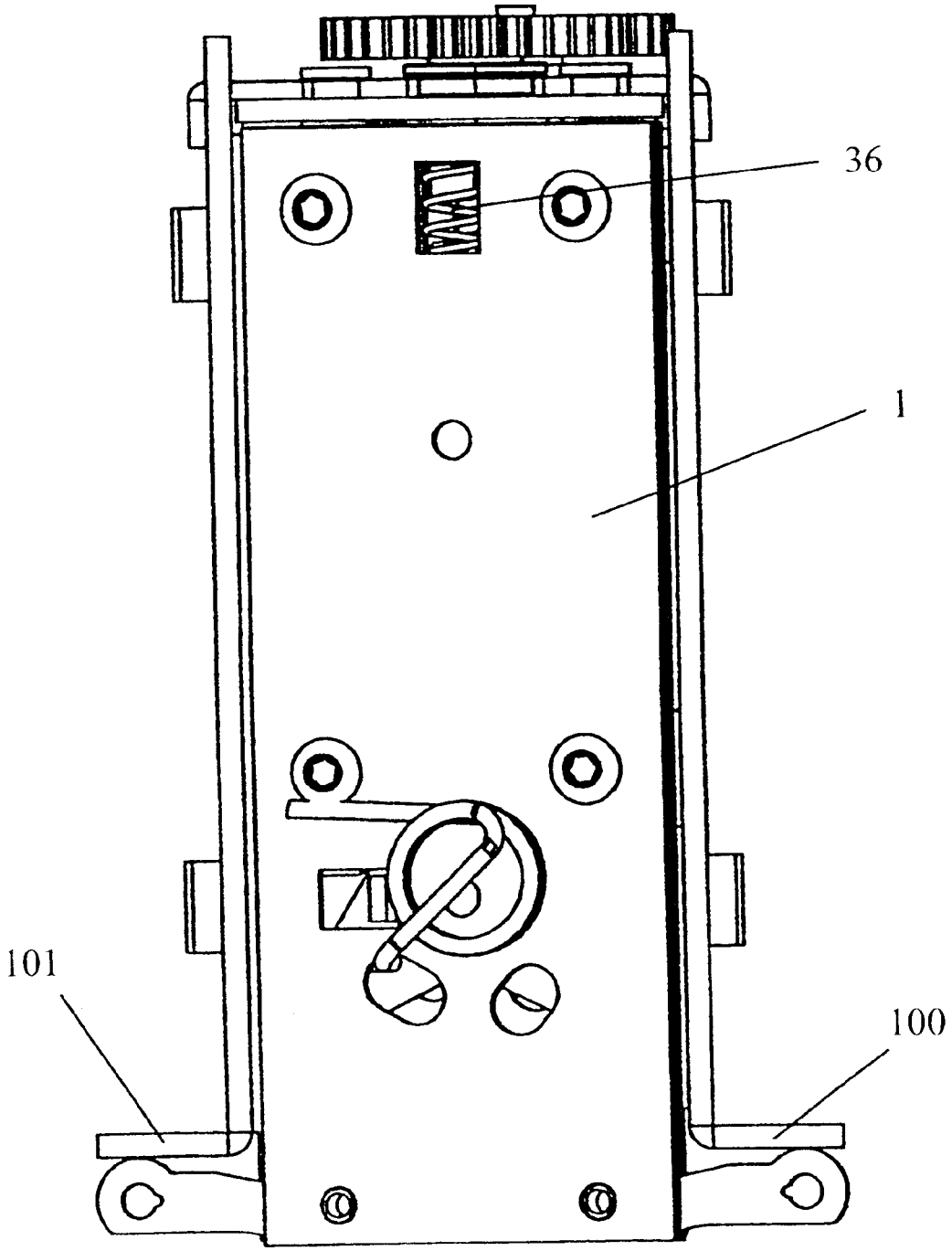

As the guide plate 2 is lifted relative to the first and third plate 1, 3 as well as relative to the clinching wings 7, 17 and associated parts which are, as described above, mounted respectively on the first and third plates, the projecting lips 60 move out of engagement with the hooks 16 of the actuating levers 8, 18. This releases each lever 8, 18 to pivot against the camming surface of its associated clinching wing under the loading of the springs 12, 22, which clinching wings 7, 17 are, in turn, caused to rotate about their pivot points towards their second, clinched positions, whereupon the legs 72 of the staple are clinched as shown in FIGS. 17 and 20. The hooks 16 are preferably 3 mm high or less so that, as described above the second plate need only move through a maximum of 3 mm to release the actuating levers 8, 18.

Figure 26:
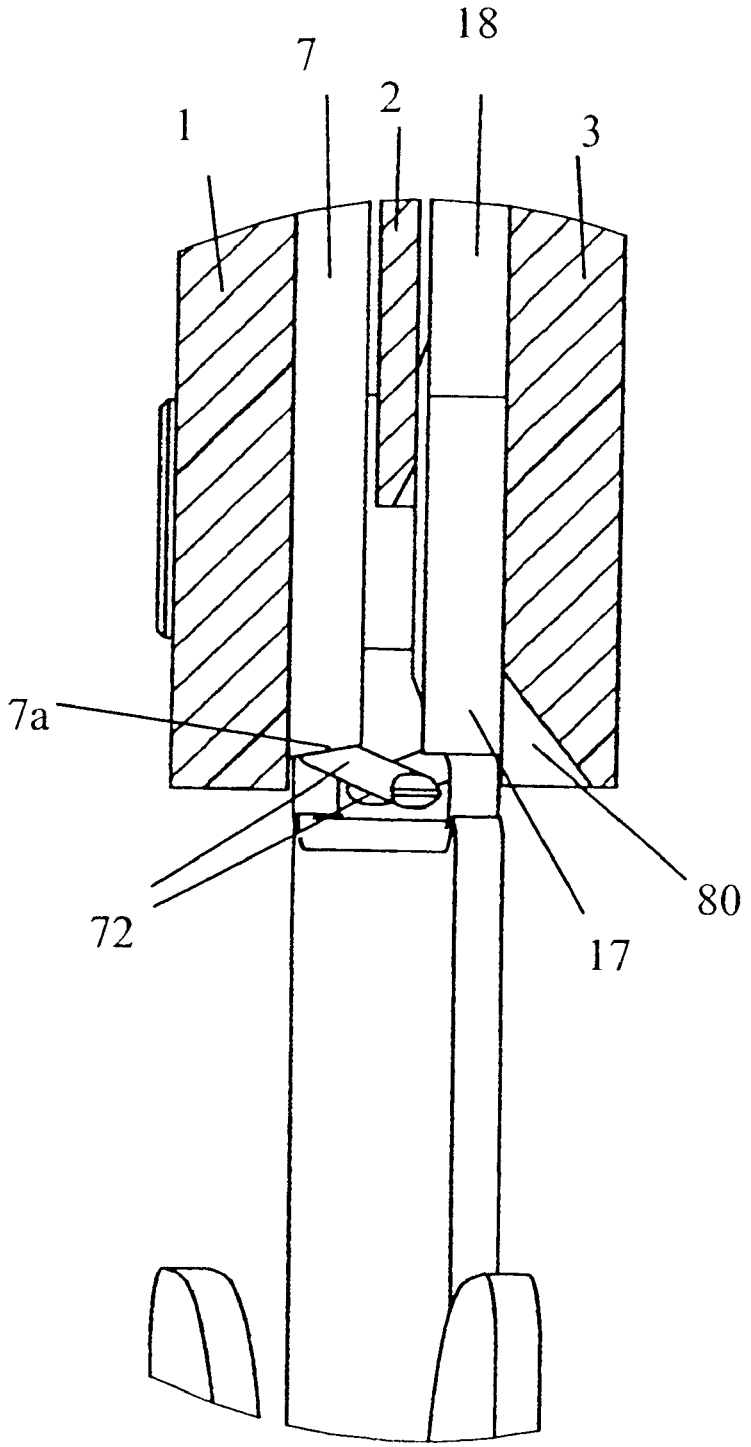
FIG. 26 is a perspective view of a clinched staple showing the chamber on the clinching faces of the clinching wings which urges the clinched legs substantially into alignment with the staple crown.

As illustrated more clearly in the enlarged perspective view of FIG. 26, the clinching surfaces 7*a*, 17*a* of the clinching wings 7, 17 are inclined towards each other so that, as each wing 7, 17 presses it's associated staple leg during its movement towards its clinched position, a camming action is developed between the clinching surface and the staple leg which urges the two staple legs towards each other. Since the guide plate 2, which separates the two legs 72 as they are pressed through the paper stack 70 and guides them into engagement with the clinching surface 7*a*, 17*a* of their associated clinching wing 7, 17, is withdrawn, preferably by up to 3 mm, prior to clinching, the inclined clinching surfaces on the clinching wings 7, 17 ensure that the legs 72 of the staple are pressed together laterally during the final stages of the clinching movement so that they lie side-by-side without any unnecessary space therebetween when the clinching operation is completed.

Figure 22:
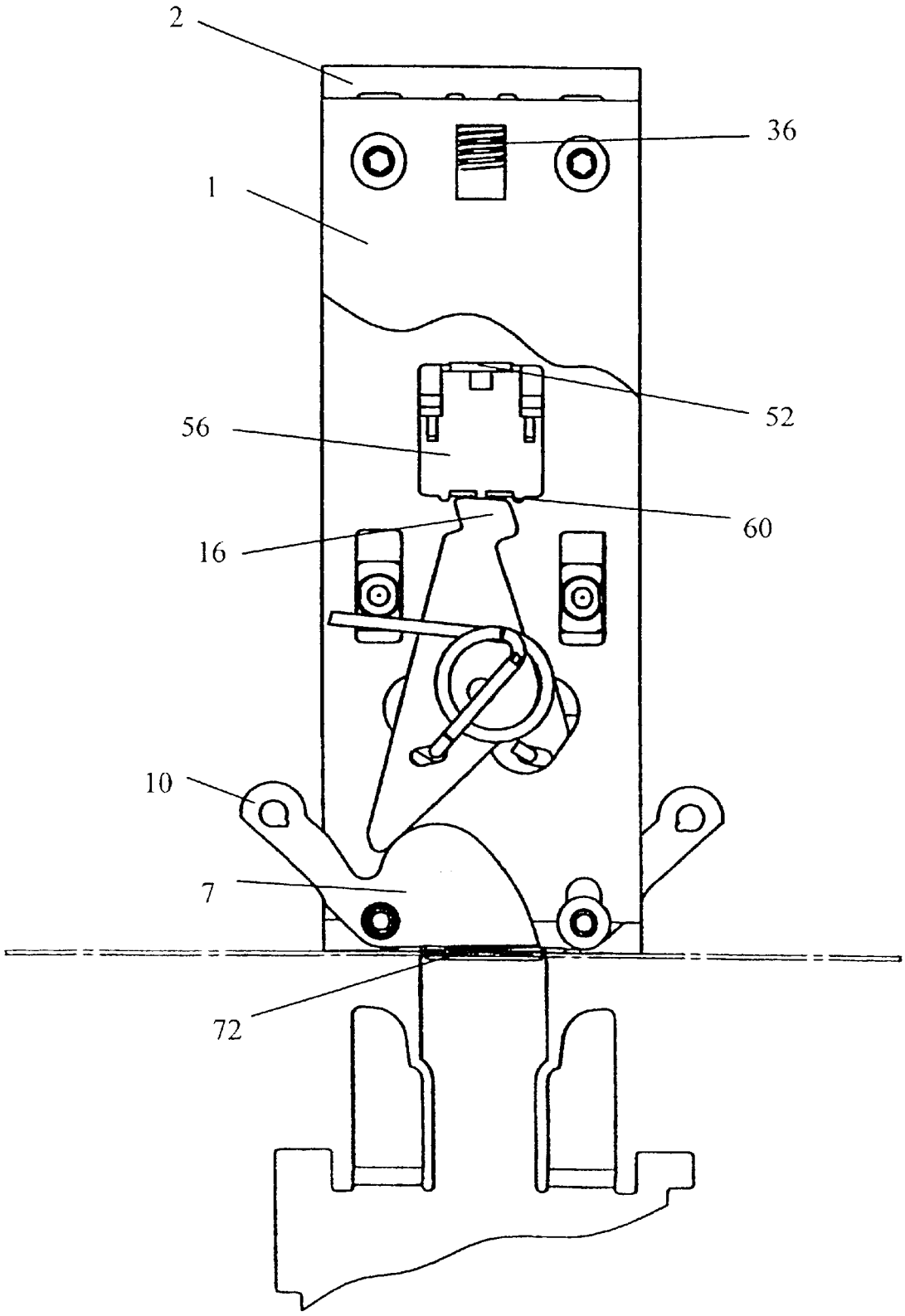
Figure 23:
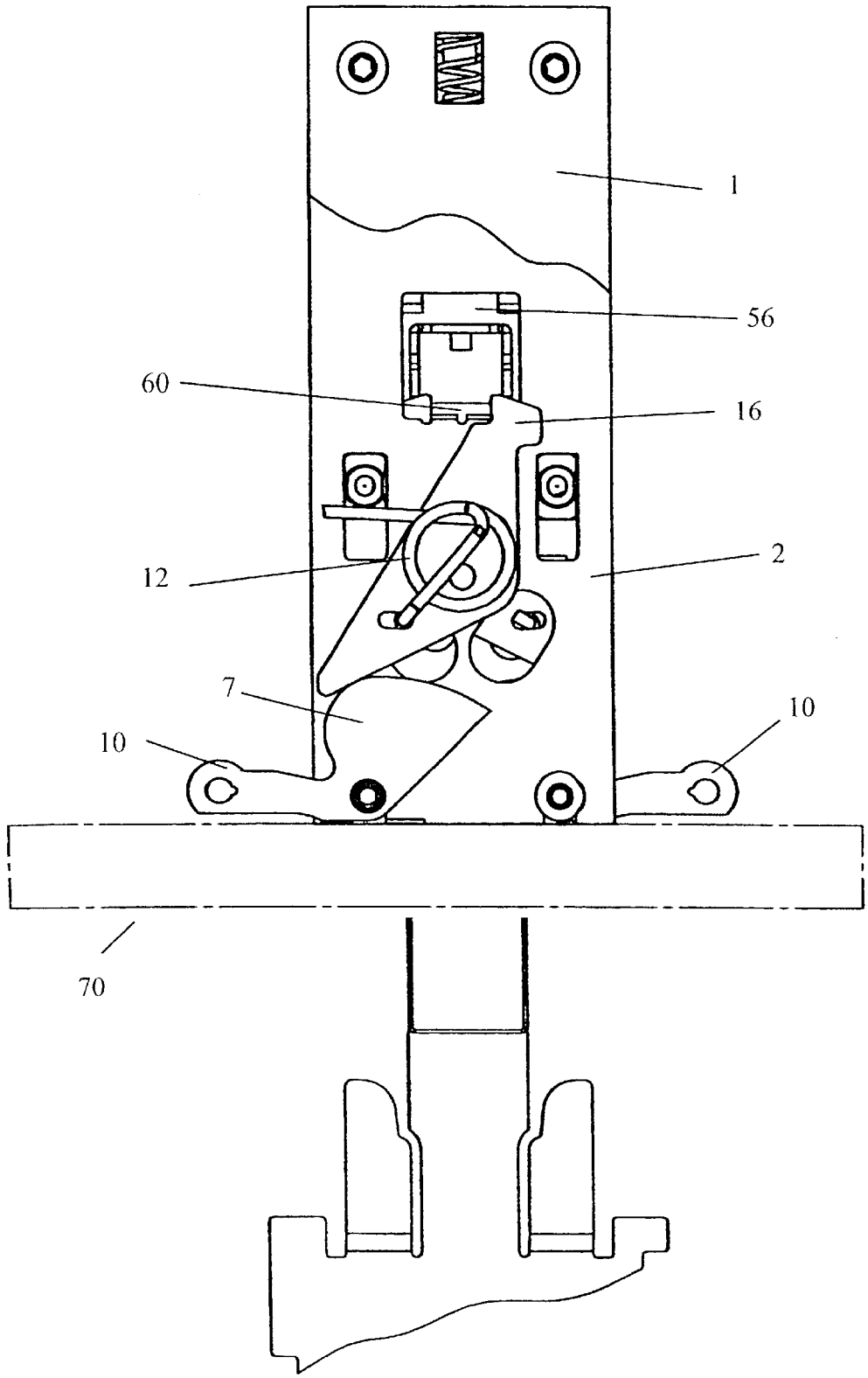
FIGS. 23 to 25 are cut away from views of the clinching mechanism of claim 1 showing the mechanism in three different positions during the clinching of a staple which is used to fix a thick work piece.

The lifting bracket 51 continues to lift the guide plate 2 until the panel 52 reaches the ramps 57 formed at the top of the enlarged section of the 'T' shaped aperture 55, whereupon the camming effect of the ramps on the flank portions of the bracket 51 causes the bracket 51 to withdraw from the apertures 55, 56 towards the slide bar 44 against the loading of the spring 50. This allows the slide bar 44 to continue travelling upwards, driven by the motor 67 through the worm gear 45, whilst the plates 1, 2, 3 remain stationary relative thereto, the guide plate being prevent from returning to its first position aligned with the first 1 and third 3 plates under the biasing action of the spring 36, due to the hooked ends 16 of the actuating levers 8, 18 engaging under the projecting lips 50 as shown in FIG. 22.

Figure 14:
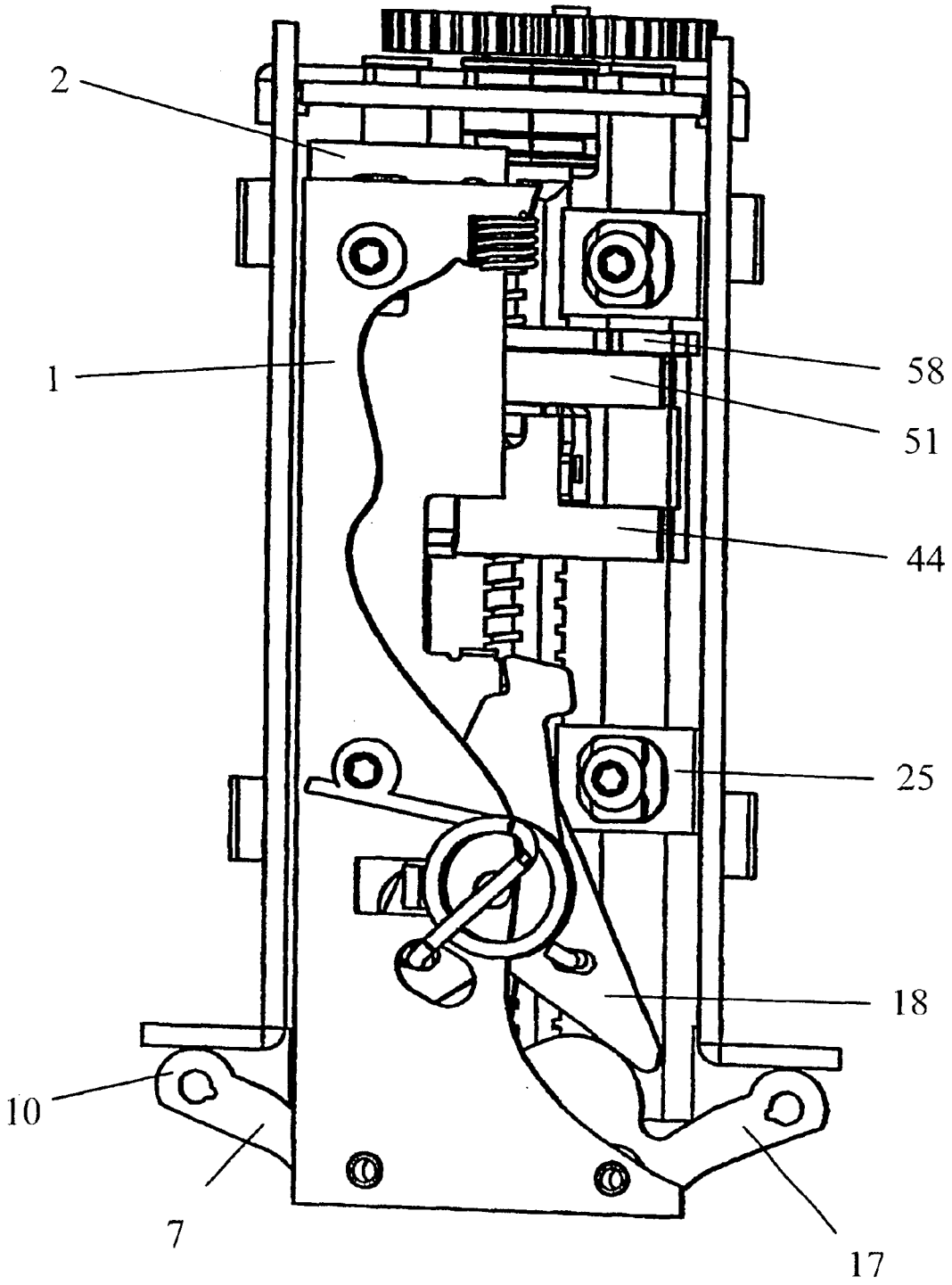
Figure 15:
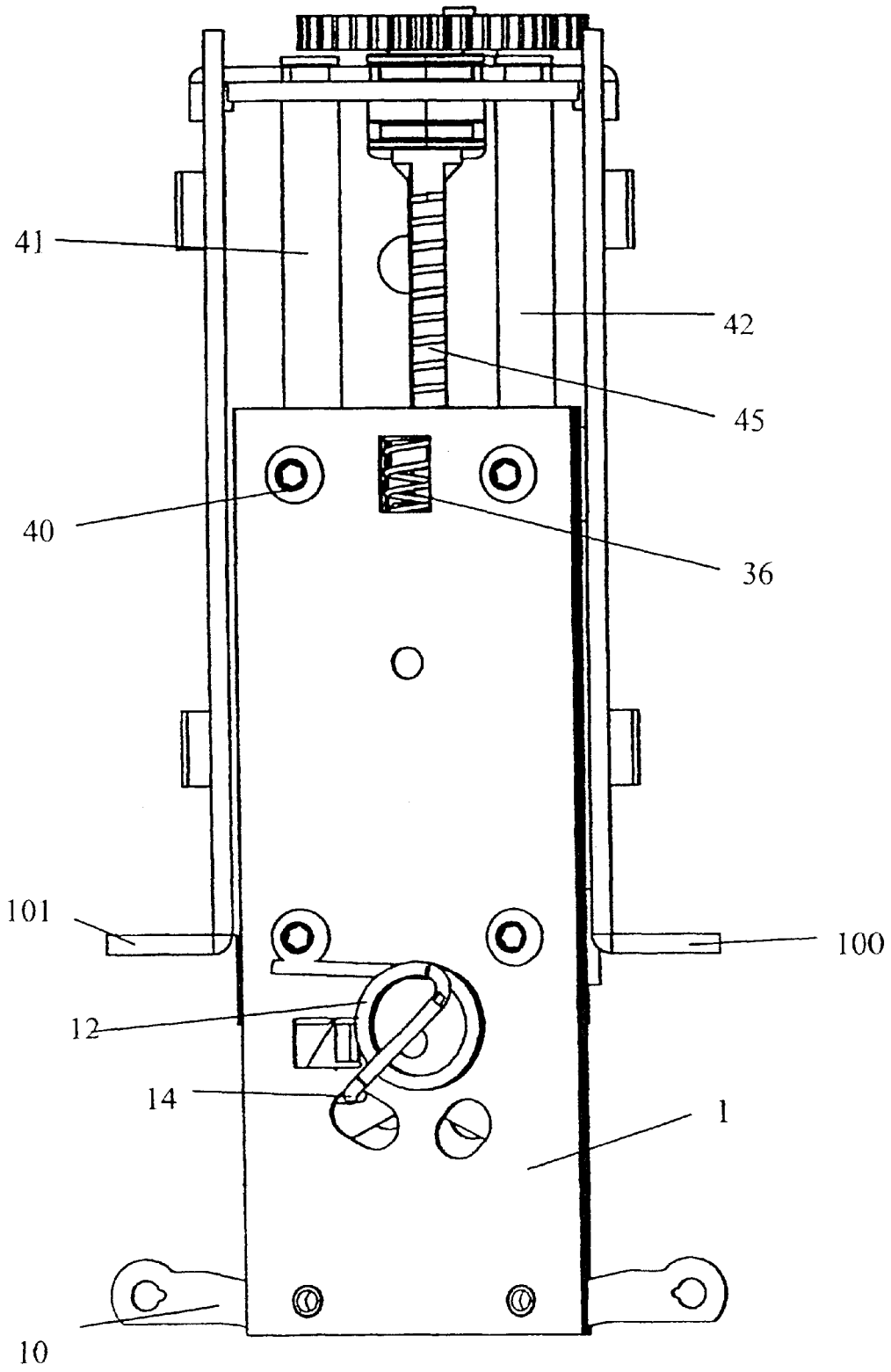
FIGS. 15 to 19 are front views of the mechanism of the invention in its various different stages of clinching of a staple.
Figure 16:
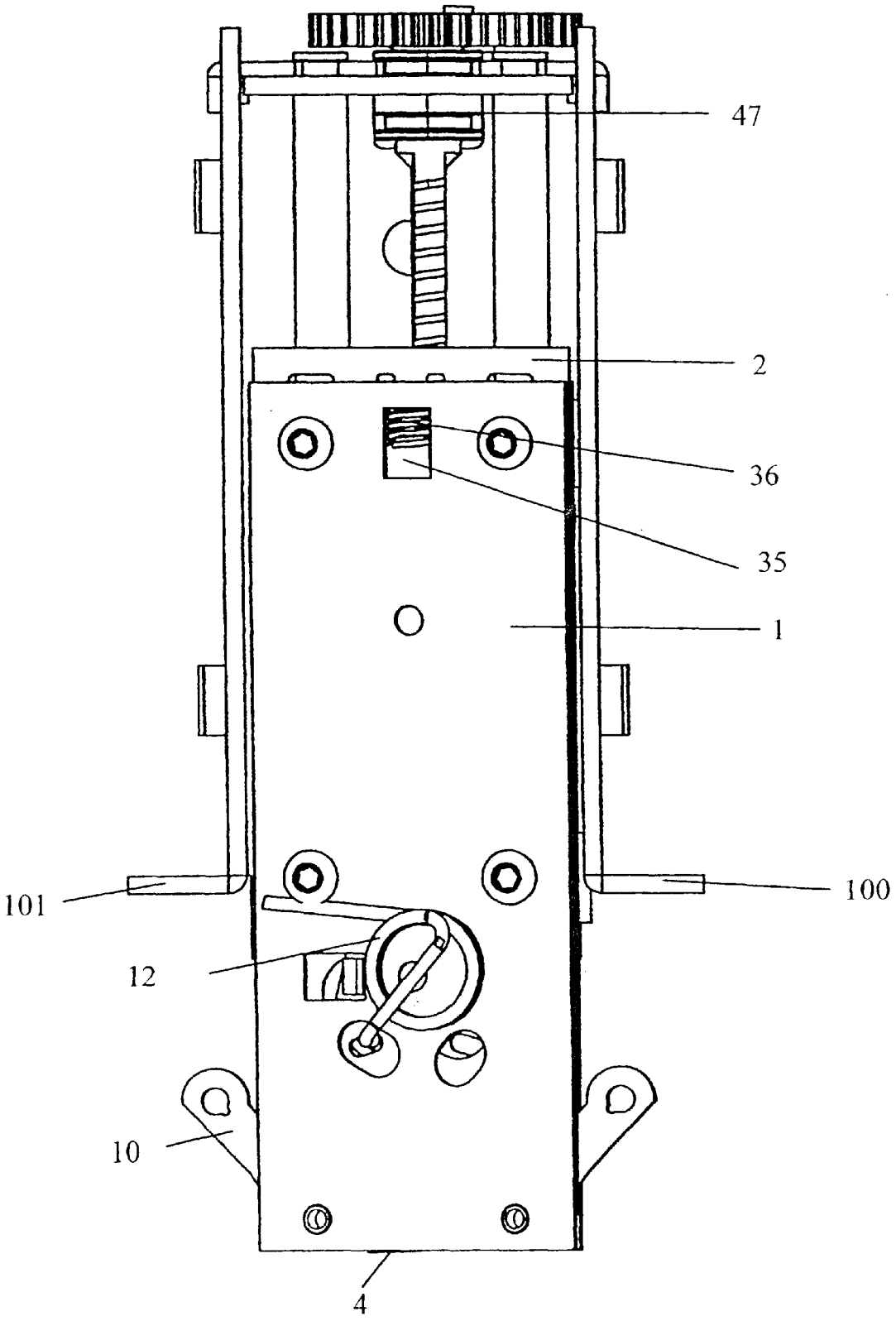

As the slide bar 44 approaches the locking plate 58, it pushes the tilted lower end upwards against the action of the spring 59 until the plate 58 is level and then drives the locking plate 58 upwards, taking the three plates 1, 2, 3 and the bushes connected thereto with it. As the plates 1, 2, 3 and connected parts are driven back upwards into the housing 43, the laterally projecting second lever arms 10 of the clinching wings 8, 18 engage against flanking plates 100, 101 formed on the housing and are pressed downwards as shown in FIGS. 13 and 14, causing the clinching wings 7, 17 and the associated actuating levers 8, 18 to return to their first position against the force of the springs 12, 22. Once the hooks 16 of the actuating levers have disengaged from beneath the lips 60 on the guide plate 2, the guide plate is free to slide downwards relative to the first 1 and third 3 plates, under the action of the restoring spring 36 and to return to its first position, whereupon the lips 60 re-engage against the sides of the hooks 16 so as to lock the clinching wings 7, 17 in their first unclenched positions ready for the next operation.

Preferably, the plates 1, 2, 3 each have staple leg guide ramps 80 extending away from their bottom edges 4, 5, 6 on the faces between which the clinching wings 7, 17 are located. If the leg 72 of a staple is perfectly aligned with its target slot formed by the space between neighbouring plate 1, 2; 2, 3, it will engage the sloping surface of one of the guide ramps 80 and be guided into the slot, and hence into proper engagement with the clinching surface 7*a* of the clinching wing 7 as it is pressed through the paper stack 70.

Although in the illustrated embodiment the projecting lips 60 on the guide plate are formed on the bottom edge of the lifting aperture, it will, of course, be understood that they could also be positioned elsewhere as long as the actuating levers are sized and positioned so as to interact with the lips 60 in the manner described above. Furthermore, instead of being inclined, the clinching surfaces of the clinching wings may be curved or otherwise shaped so as to develop a camming action with the legs 72 of the staple, it merely being required that the clinching surfaces press the staple legs towards each other in order to ensure that they are separated by the minimum distance when the clinching operation is completed.

What is claimed is:

1. A clinching assembly for guiding and clinching a staple, comprising first, second and third plates arranged in a spaced apart stack with said second plate positioned between said first plate and said third plate, first clinching apparatus located between said first plate and said second plate and operable, in use, to clinch a first staple leg received in a first slot formed by the space between said first plate and said second plate, and second clinching apparatus located between said second plate and said third plate and operable, in use, to clinch a second staple leg received in a second slot formed in the space between said second plate and said third plate, wherein said first and third plates have at least one aligned edge forming an anvil surface of the clinching assembly, and said second plate is movable relative to said first and third plates between a first aligned position in which it has an edge aligned with said anvil surface so as to prevent interference between the staple legs as they engage in their respective slots, and a second retracted position in which said edge is withdrawn from said anvil surface so as, in use, to be at least partially retracted from between said inserted staple legs.

2. A clinching assembly according to claim 1, wherein said first and second clinching apparatus have clinching surfaces that are inclined towards each other such that, in use, a camming action arise between the each clinching apparatus and its associated staple leg which presses the staple leg laterally substantially into alignment with the crown of the staple.

3. A clinching assembly according to claim 1, further including plate biasing apparatus in the form of a compression spring that engages in three apertures formed in said first, second and third plates which are aligned when said second plate is in its first aligned position, said axis of said compression spring being parallel to the direction of movement of said second plate relative to said first and third plates, whereby said second plate is biased into said first position.

4. A clinching assembly according to claim 1, wherein said first and second clinching apparatus each include a clinching wing that is pivotally mounted on one of said plates and is rotatable between a first unclinched position and a second clinched position, clinching biasing apparatus associated with said clinching apparatus which urge said clinching apparatus into their clinched positions, and locking apparatus operable to retain said clinching apparatus in their unclinched position against the force of the biasing apparatus.

5. A clinching assembly according to claim 4, wherein said locking apparatus is a projecting lip formed on each side of said second plate which, in said first aligned position of said second plate, engage said first and second clinching apparatus respectively so as to lock them in their unclinched positions.

6. A clinching assembly according to claim 4, wherein each clinching apparatus includes an actuating member which is actuatable to engage its associated clinching wing and move it to its clinched position, in said first aligned position of second plate, said locking apparatus engaging with said actuating members and preventing actuating movement thereof.

7. A clinching assembly according to claim 6, wherein in said second retracted position of said second plate, said actuating members engage underneath said locking apparatus so as to prevent the second plate returning to its first position.

8. A clinching assembly according to claim 6, wherein said first and second actuating members are pivotally mounted to said first and third plates respectively, and said clinching biasing apparatus engage said first and second actuating members so as to bias against its associated clinching wing.

9. A clinching assembly according to claim 4, wherein each clinching wing includes a lever arm which projects from the outer periphery of the plates and is actuatable to rotate said its clinching from a clinched to an unclinched position.

10. A clinching assembly according to claim 9, wherein the housing the lever arms of the clinching apparatus engage fixed flange portions of the assembly as the plates move from their extended position to their retracted position so as to move said clinching wings from their clinched to their unclinched positions, thereby releasing the second plate to return to its aligned position relative to said first and third plates under the force of the biasing apparatus.

11. A clinching assembly according to claim 1, further including a housing having slide bars on which are slidably mounted bushes to which said plates are connected so as to be movable relative to said housing.

12. A clinching assembly according to claim 11, wherein each of said first, second and third plates include mounting apertures in which studs on said bushes engage, said apertures in said first and third plates are of complementary size and shape to the cross-section of said studs such that said plates are constrained to move with each other and with said studs relative to said housing, and said apertures in said second plate being elongated towards the anvil surface as compared to the cross-section of said stud such that said second plate is movable along said studs by a limited amount.

13. A clinching assembly according to claim 11, further including a locking plate slidably mounted on said slide bars and operable to lock said fist and third plates against movement relative to said housing.

14. A clinching assembly according to claim 13, wherein said locking plate is tiltable relative to said slide bars between a first level position in which the plate is slidable along said bars and a second inclined position in which the plate frictionally engages the bars so as to restrain sliding movement therealong, a tilting spring being positioned asymmetrically on the locking plate between said plate and one of said bushes, which spring biases said plate into its inclined position.

15. A clinching assembly according to claim 1, further comprising a drive head which is driven by drive means to operate the assembly and which includes a bracket that protrudes from a face of said head and engages in elongated apertures formed in the second and third plates for coupling the plates to the movement of the drive head, said bracket being retractable from the apertures into the drive head, and wherein the drive head including bracket biasing means which biases the bracket into a protruding position in which it protrudes into said apertures.

16. A clinching assembly according to claim 15, wherein the edges of said elongated apertures in said second and third plates proximate to said anvil surface are aligned when the second plate is in its aligned position such that, upon movement of the drive head along the slide bars in the direction of the anvil surface into, said bracket engages said edges and moves said first, second and third aligned plates relative to said housing into an extended position so as, in use, to press said anvil surface against a work piece.

17. A clinching assembly according to claim 16, wherein said elongated aperture in said second plate is shorter in the direction of movement of the drive head than that in said third plate such that upon movement of the drive head along said slide bars away from the anvil surface, said bracket engages the edge of said elongated aperture in said second plate remote from the anvil surface and moves said second plate relative to said first plate, said third plate and said housing from its first aligned position to its second retracted position whilst said first and third plates remains stationary relative to said housing.

18. A method of clinching a staple comprising the steps of inserting the staple legs through a work piece into a clinching assembly on opposite sides of a guide plate, retracting the guide plate from between the staple legs and then clinching the staple legs.

19. A method of clinching a staple according to claim 18, comprising the further steps of driving the face of an anvil composed of three spaced apart and stacked plates against one side of a workpiece, pressing a staple through from the other side of the work piece so that the legs engage in apertures on opposite sides of the middle of said stack plates which forms said guide plate, retracting said guide plate relative to the side plates, actuating clinching means to clinch the staple legs against the work piece, withdrawing the anvil from the workpiece and returning the guide plate to its original position relative to said side plates.

* * * * *